US009627767B2

(12) United States Patent
Liu et al.

(10) Patent No.: US 9,627,767 B2
(45) Date of Patent: Apr. 18, 2017

(54) HIGH EFFICIENCY ANTENNA

(71) Applicant: Netgear, Inc., San Jose, CA (US)

(72) Inventors: Chia-Wei Liu, Cupertino, CA (US); Joseph Amalan Arul Emmanuel, Cupertino, CA (US)

(73) Assignee: NETGEAR, INC., San Jose, CA (US)

( * ) Notice: Subject to any disclaimer, the term of this patent is extended or adjusted under 35 U.S.C. 154(b) by 0 days.

(21) Appl. No.: 14/942,982

(22) Filed: Nov. 16, 2015

(65) Prior Publication Data

US 2016/0248162 A1 Aug. 25, 2016

Related U.S. Application Data

(63) Continuation of application No. 13/480,132, filed on May 24, 2012, now Pat. No. 9,190,729.

(51) Int. Cl.

| | |
|---|---|
| ***H01Q 9/28*** | (2006.01) |
| ***H01Q 1/38*** | (2006.01) |
| ***H01Q 1/36*** | (2006.01) |
| ***H01Q 5/371*** | (2015.01) |

(52) U.S. Cl.

CPC ..... *H01Q 9/285* (2013.01); *H01Q 1/36* (2013.01); *H01Q 1/38* (2013.01); *H01Q 5/371* (2015.01)

(58) Field of Classification Search

CPC ..... H01Q 9/285; H01Q 5/371; H01Q 1/38; H01Q 1/36

See application file for complete search history.

(56) References Cited

U.S. PATENT DOCUMENTS

| | | | |
|---|---|---|---|
| 2008/0291104 | A1 | 11/2008 | Kanno et al. |
| 2009/0213025 | A1 | 8/2009 | Coupez et al. |
| 2010/0231477 | A1 | 9/2010 | Kuramoto et al. |

FOREIGN PATENT DOCUMENTS

| | | | |
|---|---|---|---|
| CN | 101385199 | A | 3/2009 |
| TW | I335689 | B | 1/2011 |
| TW | I352454 | B | 11/2011 |

*Primary Examiner* — Hoang V Nguyen
*Assistant Examiner* — Michael Bouizza
(74) *Attorney, Agent, or Firm* — Perkins Coie LLP

(57) ABSTRACT

Antenna designs are disclosed that exhibit both high bandwidth and efficiency. A first aspect of the invention concerns the form factor of the antenna; a second aspect of the invention concerns the ease with which the antenna is manufactured; and a third aspect concerns the superior performance exhibits by the antenna across a large bandwidth.

7 Claims, 29 Drawing Sheets

HIGH EFFICIENCY ANTENNA

CROSS-REFERENCE TO RELATED APPLICATIONS

This application is a continuation of U.S. patent application Ser. No. 13/480,132, filed May 24, 2012, which is incorporated herein in its entirety by this reference thereto.

BACKGROUND OF THE INVENTION

Technical Field

The invention relates generally to antennas for wireless or RF (radio frequency) communications systems. More particularly, the invention relates to antenna designs that provide both high bandwidth and efficiency.

Description of the Background Art

It is necessary to equip receivers, transmitters, and transceivers with antennas that efficiently radiate, i.e. transmit and/or receive desired signals to/from other elements of a network to provide wireless connectivity and communication between devices in a wireless network, such as in a wireless PAN (personal area network), a wireless LAN (local area network) a wireless WAN (wide area network), a cellular network, or virtually any other radio network or system. For such antennas as are used in, for example, the 2.4 GHz and 5.0 GHz bands, it is a challenge to provide an antenna that exhibits high efficiency and that is easy to manufacture.

SUMMARY OF THE INVENTION

Embodiments of the invention provide several antenna designs that exhibit both high bandwidth and efficiency. A first aspect of the invention concerns the form factor of the antenna; a second aspect of the invention concerns the ease with which the antenna is manufactured; and a third aspect concerns the superior performance exhibits by the antenna across a large bandwidth.

DETAILED DESCRIPTION OF THE INVENTION

Figure 3:
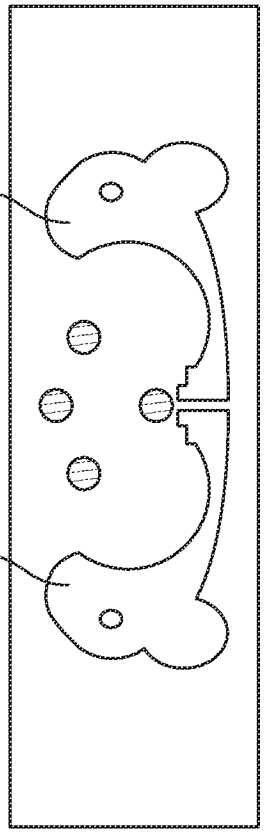
FIG. 3 is a top plan view of a PCB antenna for the 2.4 GHz band showing after production tuning according to the invention.

Embodiments of the invention provide several antenna designs that exhibit both high bandwidth and efficiency. As discussed below in greater detail, a first aspect of the invention concerns the form factor of the antenna; a second aspect of the invention concerns the ease with which the antenna is manufactured; and a third aspect concerns the superior performance exhibits by the antenna across a large bandwidth. Those skilled in the art will appreciate that other features of the invention contribute to the art and are thus new and unobvious, and that the discussion herein is not intended to limit the scope of the invention in any way. The foregoing key aspects of the invention are discussed overall in greater detail below. Thereafter, several specific embodiments of the herein disclosed invention are described.

Form Factor

Embodiments of the invention allow for the production of an antenna having a small form factor that, at the same time, exhibits exceptional performance. The size of the antenna is critical because such products as routers and the like can use a minimum of four to six antennas. In such applications, the size of the antenna plays a huge role. If the antenna size is big, it is not possible to accommodate six antennae in one particular product.

The herein disclosed antenna is readily manufactured in any required form factor. For example, the antenna may be manufactured for internal installation within a device, such as a router, or it can be manufactured for external installation within a housing, for example as a remote antenna. In either application, the antenna may be fabricated identically. Thus, it is not necessary to maintain an inventory of antennas for separate applications. Rather, the only need of an inventory is that which contains antennas for each desired band or combination of bands. In all other aspects, the antennas herein disclosed can be universally applied.

Manufacturability

The exemplary antenna according to the invention is formed as a conductive, e.g. metallic, pattern on a printer circuit board (PCB) or similar substrate. Uniquely, the formation of the antenna elements in this fashion provides reliable performance a wide bandwidth. The antenna is easy to manufacture because it is formed as a single layer on a PCB substrate. Thus, while the state of the art comprises multilayer antennas that need a feed through and, thus a high cost, precision PC manufacturer, an antenna manufactured according to the invention is formed on a single layer PCB (although embodiment of the invention may be formed on multi-layer PCBs, if desired). Accordingly, the herein disclosed antenna is readily made by any manufacturer having basic PCB fabricating facilities. Because such manufacture is relatively low tech, antenna yields, cost of manufacture, the use of commonly available materials and equipment, and the like all contribute to a low cost, high quality antenna. Thus, conventional PCB and similar known manufacturing techniques can be readily used to produce large quantities of the antenna with precision and at low cost.

Performance

As disclosed herein, careful selection and design of the antenna shape provides resonance over a wide range of frequencies within a band, thus exhibiting broad bandwidth while also providing excellent radiation performance. As such, an important part of the invention is the shape of the antenna. Thus, in an embodiment, each of the antenna's elements is a mirror image of the other, each antenna element has a planar conductive surface and is affixed to a rigid substrate, and each antenna element is formed with a specific, curved perimeter profile. The unique and specific perimeter shape of each antenna element increases the frequency of resonance of the antenna across a wide band, thus making the antenna well suited for communications in the 2.4 GHz, 5.0 GHz, and 3G/LTE (700/800 and 1700/1900 MHz,) bands. While in the state of the art the perimeter shape of an antenna is typically a rectangle or square, which limits the tuning capability, the curved shape of the herein disclosed antenna gives the antenna wider band coverage.

It is important to note that the shape of each antenna element has several curves and no straight edges. The antenna shape is curved to make the antenna size smaller, but also to maintain the overall length of each element, such that the perimeter of each element from end to end is preferably a quarter-wave (λ/4-wave) resonator. This arrangement provides the ability to increase the bandwidth because each bulge or curve in the antenna profile forms a quarter wave or one eighth of a wavelength that can extend the antenna bandwidth. That is, across the antennal structure there can be multiple resonant wavelengths because of the curves and protrusions in the shape of each antenna element. Thus, the periphery or perimeter of each antenna element resonates at a certain frequency. Because the shape is different across the surface of each antenna element it is possible to cover a wide band instead of a narrow band.

Another feature of the invention provides a small gap between the antenna elements which increases the bandwidth of the antenna. Providing a small gap between two antenna elements adds a larger serial capacitance value and makes the dipole antenna a low Q resonator. With a low Q resonator, the antenna input impedance and reactance are more stable; thus, the antenna can match to a 50 Ohm transmission line in a wider bandwidth.

Further, the shape and/or projection and/or profile of various portions of each antenna element are selected to tune the frequency of the antenna. For example, if an triangle shape is added to each antenna element, the triangle can be cut slightly shorter or it can be formed slightly longer to shift the frequency of the antenna and thus fine-tune the antenna. Thus, when the layout for the antenna elements on the substrate is performed, it is possible to fine-tune the antenna by adjusting the shape of the antenna elements. After production of the antenna, the antenna can be put on a test appliance, and the above-mentioned apertures can be drilled out to effect precise final fine tuning of the antenna.

Another feature of the invention provides an aperture or dot formed in or about the middle of each antenna element to provide the ability to fine-tune the antenna after production, after the antenna is formed on the substrate, for example by using a drill or other tool to enlarge the aperture.

The following discussion provides a detailed discussion of various embodiment of the invention. Such discussion is provided to show examples of the invention, but it is not intended to limit the scope of the invention on any way. In each of the examples below the PCB may be, for example, glass reinforced epoxy laminated sheets (FR4), ceramic laminates, thermoset ceramic loaded plastic, liquid crystalline circuit material; and the antenna elements may be formed of, for example copper, aluminum, silver, gold, tin).

2.4 GHz Geometry

Figure 1:
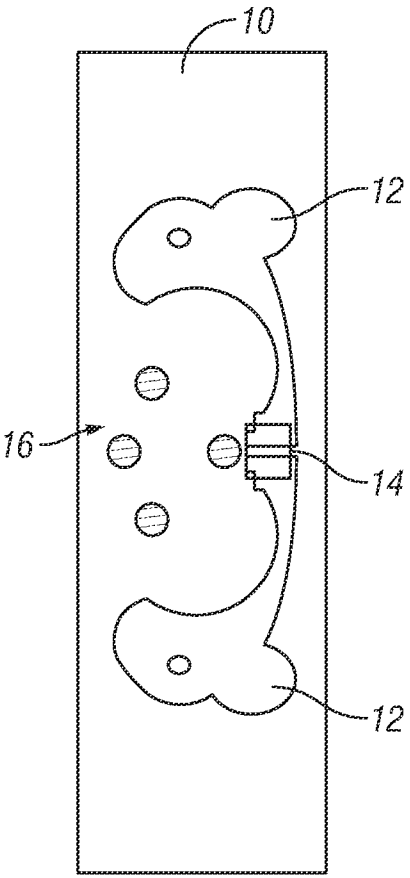
FIG. 1 is a top plan view of a PCB antenna for the 2.4 GHz band according to the invention.

FIG. 1 is a top plan view of a PCB antenna for the 2.4 GHz band according to the invention. In this embodiment of the invention, a metal layer 12 is formed in a single layer PCB 10 having, in this case, a 12 mm width, 35 mm length, and a 1.6 mm thickness, although other dimensions may be used. One or more drilled holes 16 are provided to mount the antenna. In this embodiment, the holes have a 2 mm diameter, although other diameters may be used. The antenna is connected to a respective system by an antenna cable at a cable soldering area 14.

Each antenna element is a mirror image of the other. Each element has a curved, semi-circular inner edge and an arc-shaped outer edge that define a contact portion of the antenna element, where the element extends from a narrow portion thereof to a point where the edges diverge and thus define a wide, curved upper element portion. A semi-circular projection (discussed below) extends from an upper portion of the outer antenna element edge. Each antenna element can be thought to resemble the head of a beaver in profile.

An exemplary antenna according to the invention provides an omnidirectional radiation pattern from 2.4 GHz-2.5 GHz and an S11<−10 dB from 2.4 GHz-2.5 GHz. For purposes f the discussion herein, S11 represents how much power is reflected from the antenna. If S11=0 dB, then all the power is reflected from the antenna and nothing is radiated. If S11=−10 dB, this implies that if 3 dB of power is delivered to the antenna, −7 dB is the reflected power. The rest was accepted by the antenna. This accepted power is either radiated or absorbed as losses within an antenna. Because antennas are typically designed to be low loss, the majority of the power delivered to the antenna is radiated.

Figure 2:
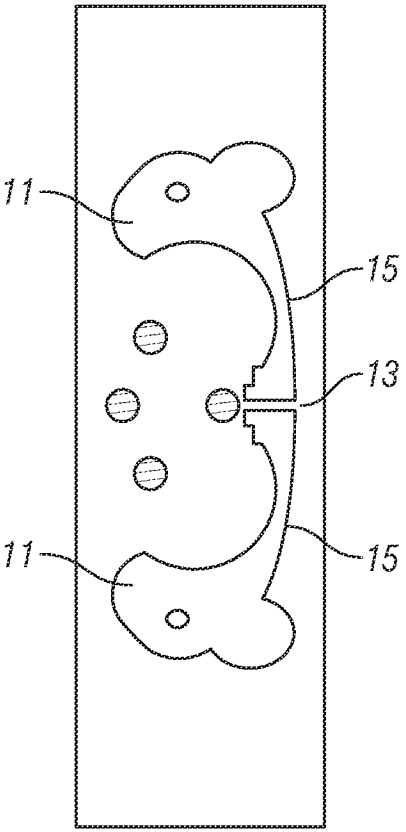
FIG. 2 is a top plan view of a PCB antenna for the 2.4 GHz band showing in simulation tuning according to the invention.

FIG. 2 is a top plan view of a PCB antenna for the 2.4 GHz band showing in simulation tuning according to the invention. As shown in FIG. 2, extending shape 11 of the antenna provides extra current flow to help miniaturize the antenna. With wider metal area, the antenna provides better bandwidth as well. A gap 13 is formed between the two antenna elements. In this embodiment, the gap is 0.5 mm, although other gaps may be used. Soldering in this area can be used to adjust the impedance and reactance of the antenna. a slightly thinner trace 15 provides serial inductance to miniaturize the antenna size.

FIG. 3 is a top plan view of a PCB antenna for the 2.4 GHz band showing after production tuning according to the invention. In this embodiment, one or more holes 17 are provided for frequency tuning after production. In this embodiment, the holes have an initial diameter of 1 mm, although other diameters can be used. The antenna is typically connected to a test appliance and the antenna characteristics are measured. A small amount of metal is removed at the tuning hole, thus enlarging the hole, for example with a drill, until the desired antenna characteristics are measured on the test appliance.

Figure 4:
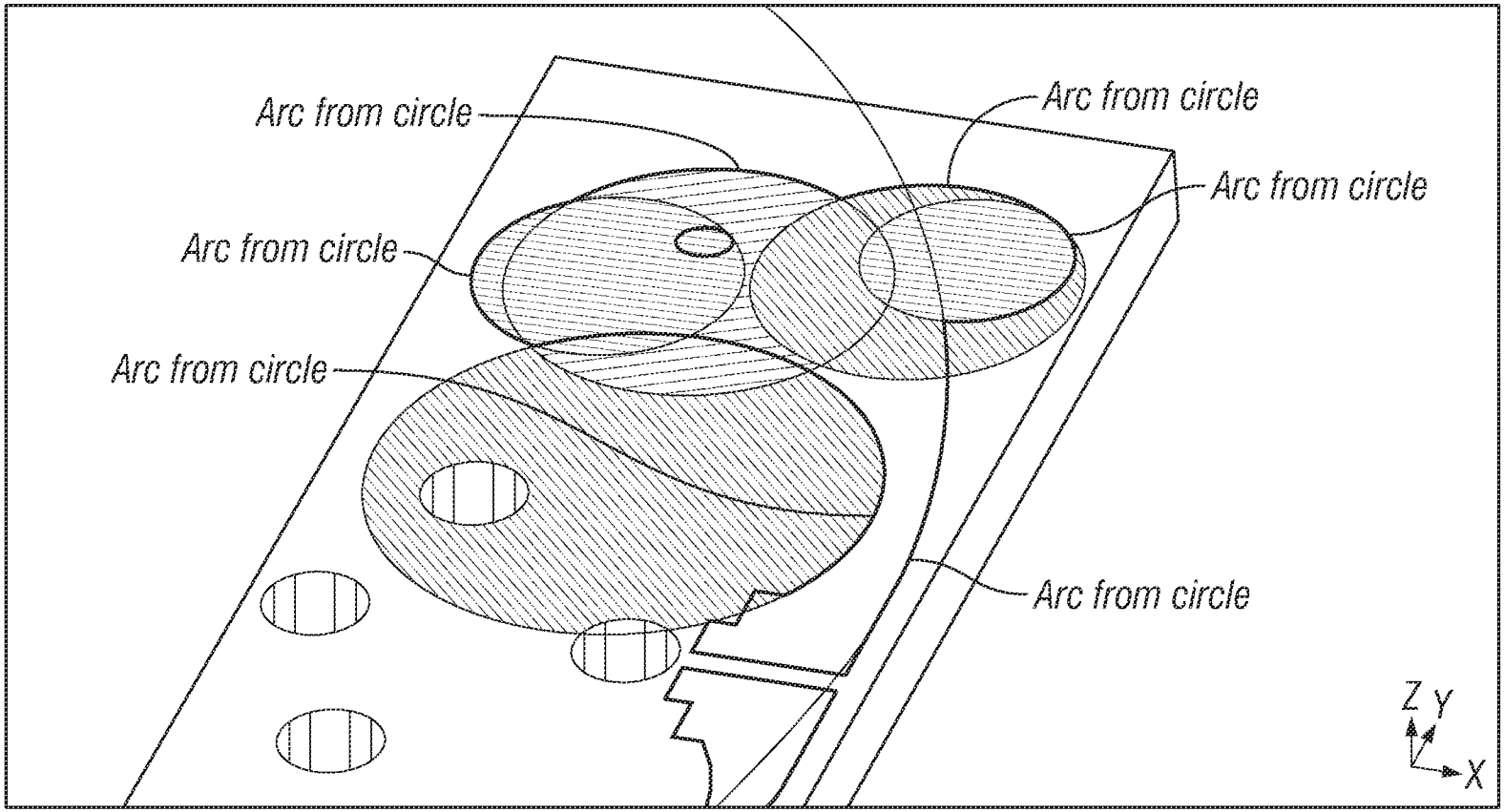
FIG. 4 is a perspective view of a substrate showing antenna layout for a 2.4 GHz antenna according to the invention.

FIG. 4 is a perspective view of a substrate showing antenna layout for a 2.4 GHz antenna. In particular, it can be seen that the unique and significant shape of the antenna elements is constructed from a series of overlapping arcs. The actual shape of the antenna element is shown in outline by a solid line, while the circles that generate the arcs are shown shaded.

Figure 5:
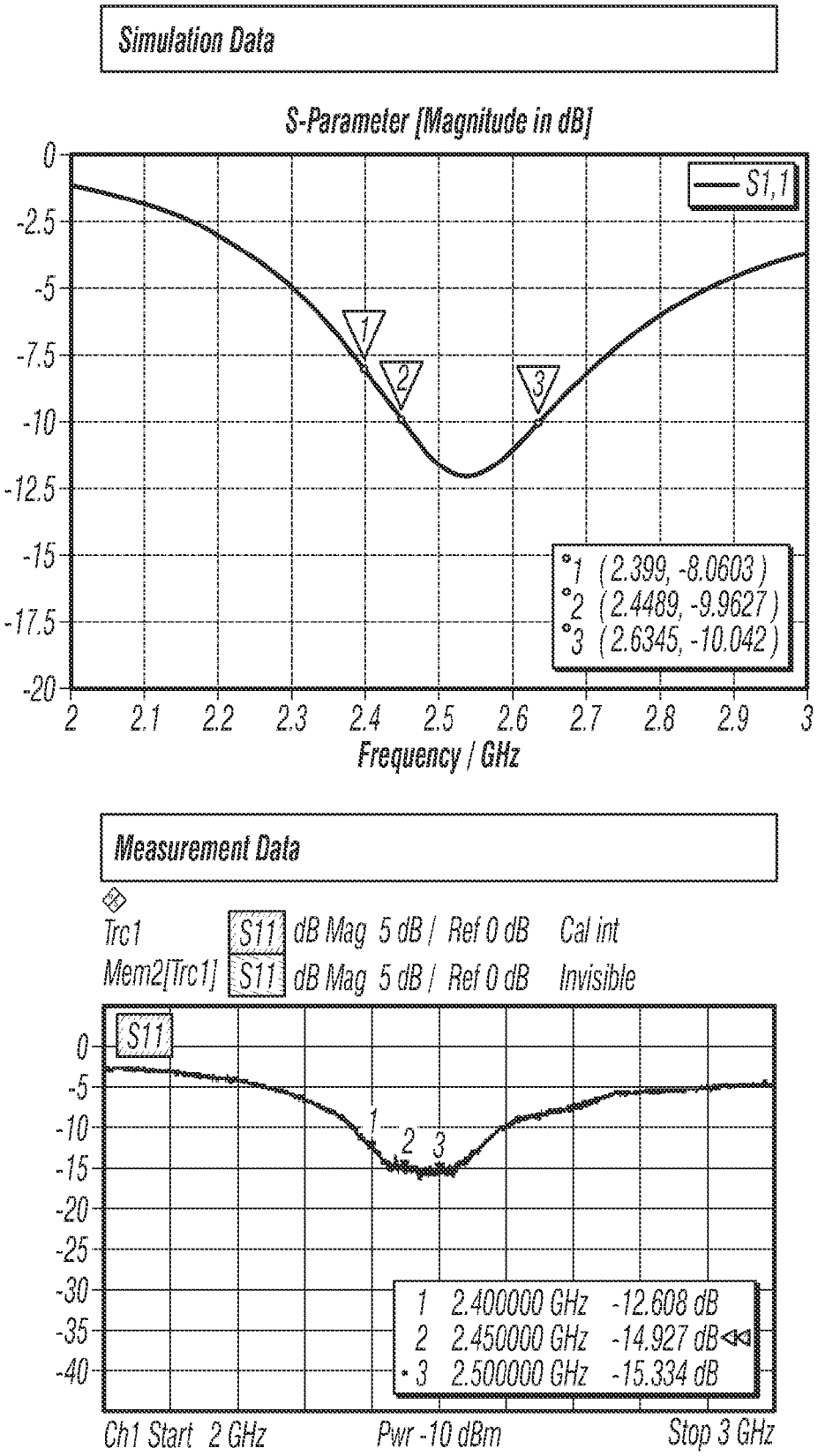
FIG. 5 provides a series of graphs showing simulation data and measurement data for a 2.4 GHz band antenna according to the invention.
Figure 5:
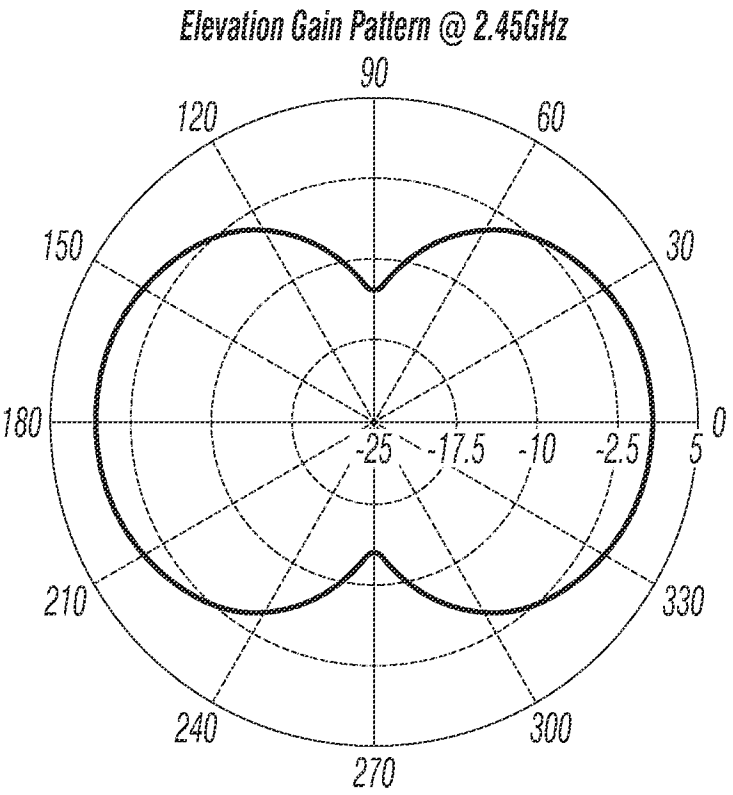
Figure 5:
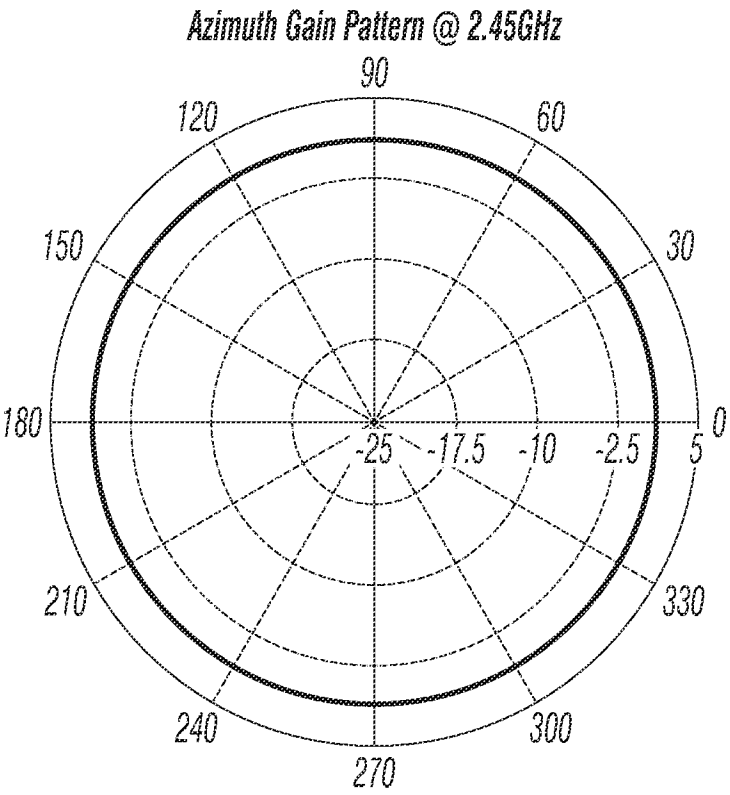
Figure 5:
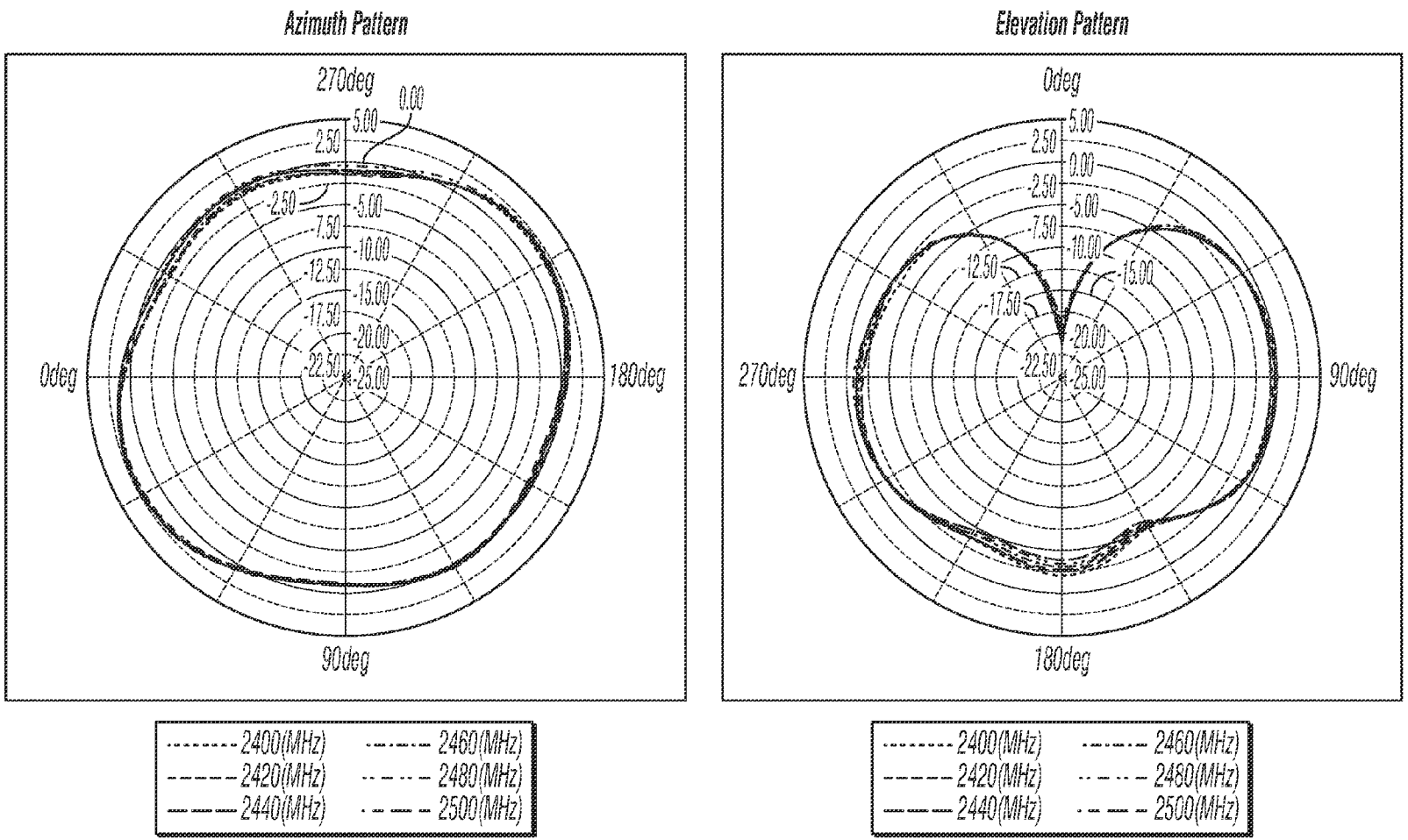

FIG. 5 provides a series of graphs showing simulation data and measurement data for a 2.4 GHz band antenna according to the invention. In particular, simulation and measurement data are shown for an S-parameter, azimuth gain, and elevation gain. As can be seen, actual measured values compare favorably with simulated values, thus confirming the merit of the antenna herein disclosed.

5 GHz Geometry

Figure 6:
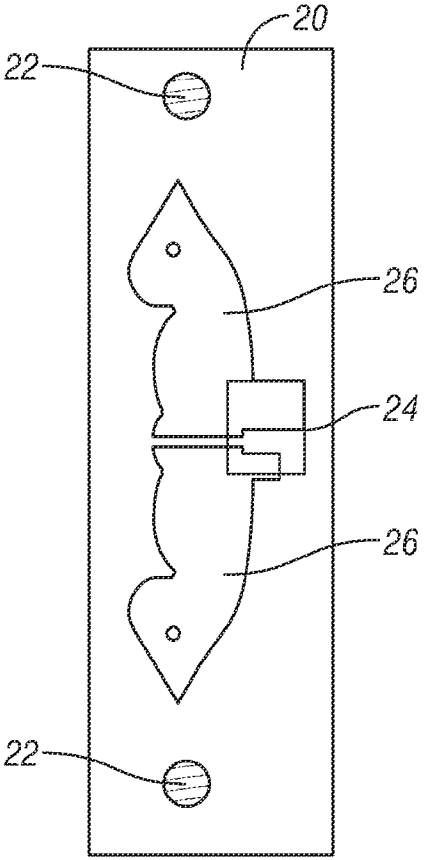
FIG. 6 is a top plan view of a PCB antenna for the 5 GHz band according to the invention.

FIG. 6 is a top plan view of a PCB antenna for the 5 GHz band according to the invention. In this embodiment of the invention, a metal layer 26 is formed in a single layer PCB 20 having, in this case, a 7.5 mm width, a 32.8 mm length, and a 1.6 mm thickness, although other dimensions may be chosen. One or more drilled holes 22 are provided to mount the antenna. In this embodiment, the holes have a 2 mm diameter. Other diameters may be used in other embodiments. The antenna is connected to a respective system by an antenna cable at a cable soldering area 24. An exemplary antenna according to the invention provides an omnidirectional radiation pattern radiation pattern from 4.9 GHz-5.9 GHz and an S11<−10 dB from 4.9 GHz-5.9 GHz with more than 20% bandwidth.

Figure 7:
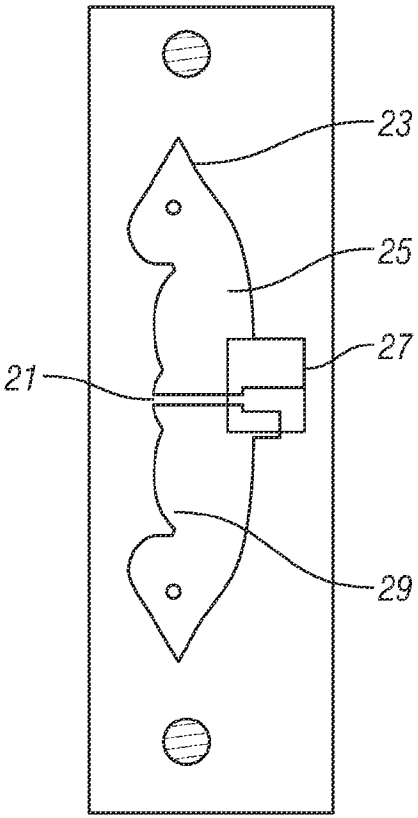
FIG. 7 is a top plan view of a PCB antenna for the 5 GHz band showing in simulation tuning according to the invention.

FIG. 7 is a top plan view of a PCB antenna for the 5 GHz band showing in simulation tuning according to the invention. As shown in FIG. 7, a critical gap 21 provides stable antenna impedance and reactance. In this embodiment, the gap is 0.5 mm, although other dimensions may be used for the gap. An additional triangle peak 23 provides serial inductance to miniaturize the antenna size. A wide metal area 25 provides wide bandwidth performance. A wide cable soldering area 27 ensures that there are no manufacturing issues in the production line. A curvature shape 29 is provided to increase the current path and further shift the resonate frequency lower.

Each antenna element is a mirror image of the other. Each element has an arc-shaped inner edge and an arc-shaped outer edge that define a contact portion of the antenna element, where the element extends from a broad portion thereof to a point where the inner edge converges, much like a French curve, and thus defines a curved upper element portion that terminates in a point where the inner edge and outer edge meet. Each antenna element can be thought to resemble the head of a bird in profile.

Figure 8:
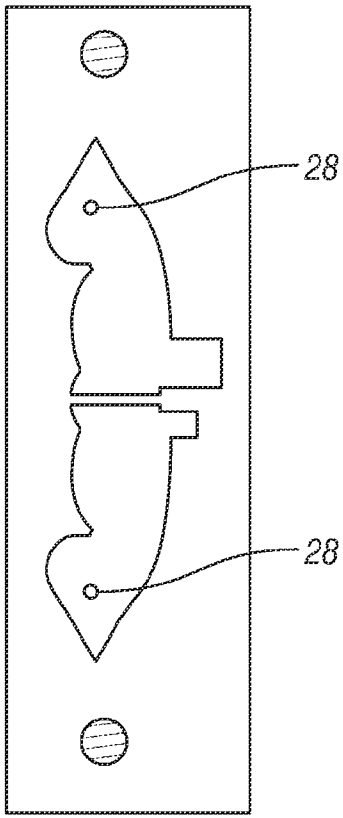
FIG. 8 is a top plan view of a PCB antenna for the 5 GHz band showing after production tuning according to the invention.

FIG. 8 is a top plan view of a PCB antenna for the 5 GHz band showing after production tuning according to the invention. During post production tuning, it is possible to enlarge the hole 28 size to decrease the antenna resonate frequency. In this embodiment, the hole is a 0.26 mm cutout, although other dimensions may be used in other embodiments.

Figure 9:
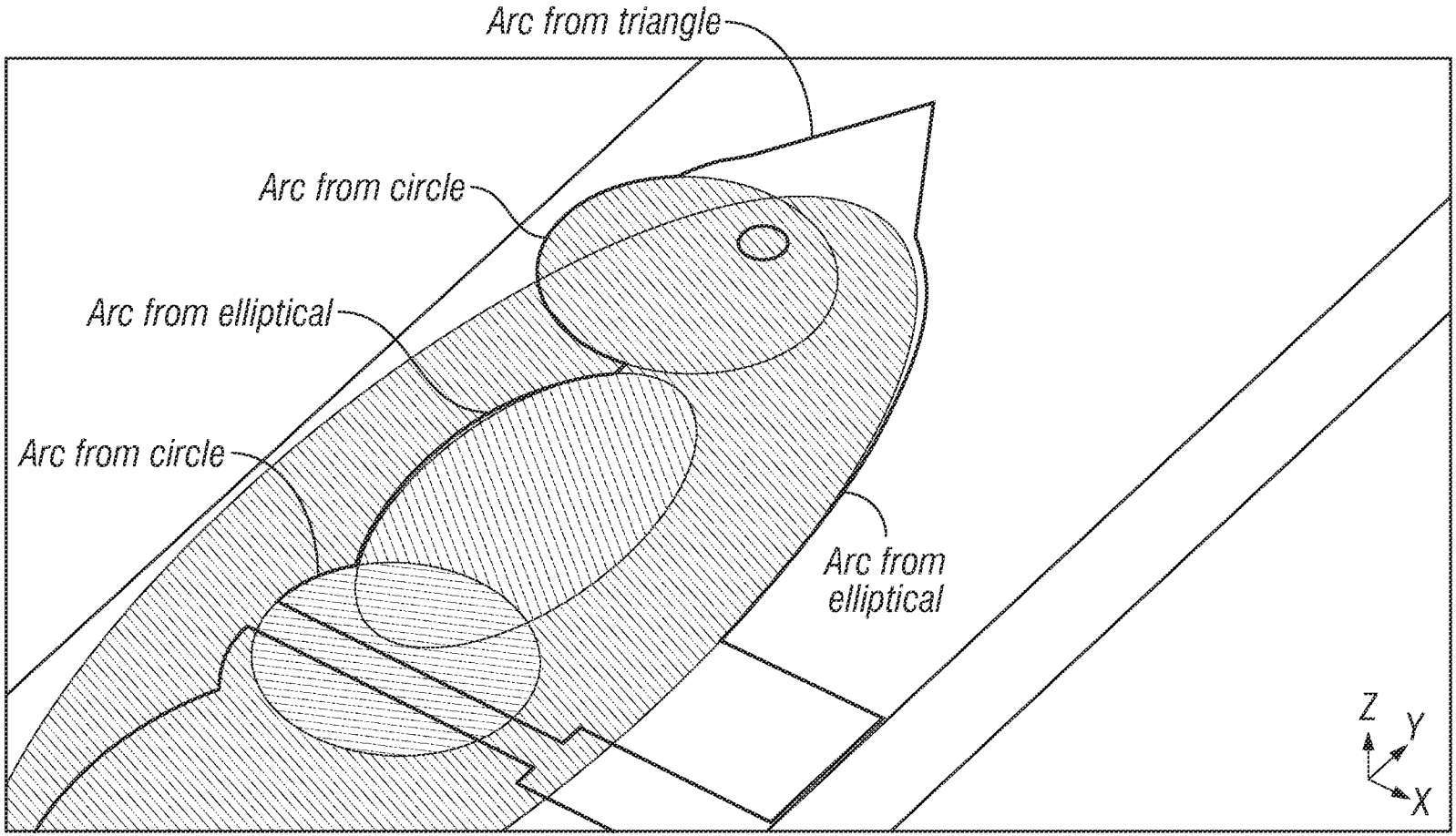
FIG. 9 is a perspective view of a substrate showing antenna layout for a 5 GHz antenna according to the invention.

FIG. 9 is a perspective view of a substrate showing antenna layout for a 5 GHz antenna. In particular, it can be seen that the unique and significant shape of the antenna elements is constructed from a series of overlapping arcs. The actual shape of the antenna element is shown in outline by a solid line, while the circles that generate the arcs are shown shaded.

Figure 10:
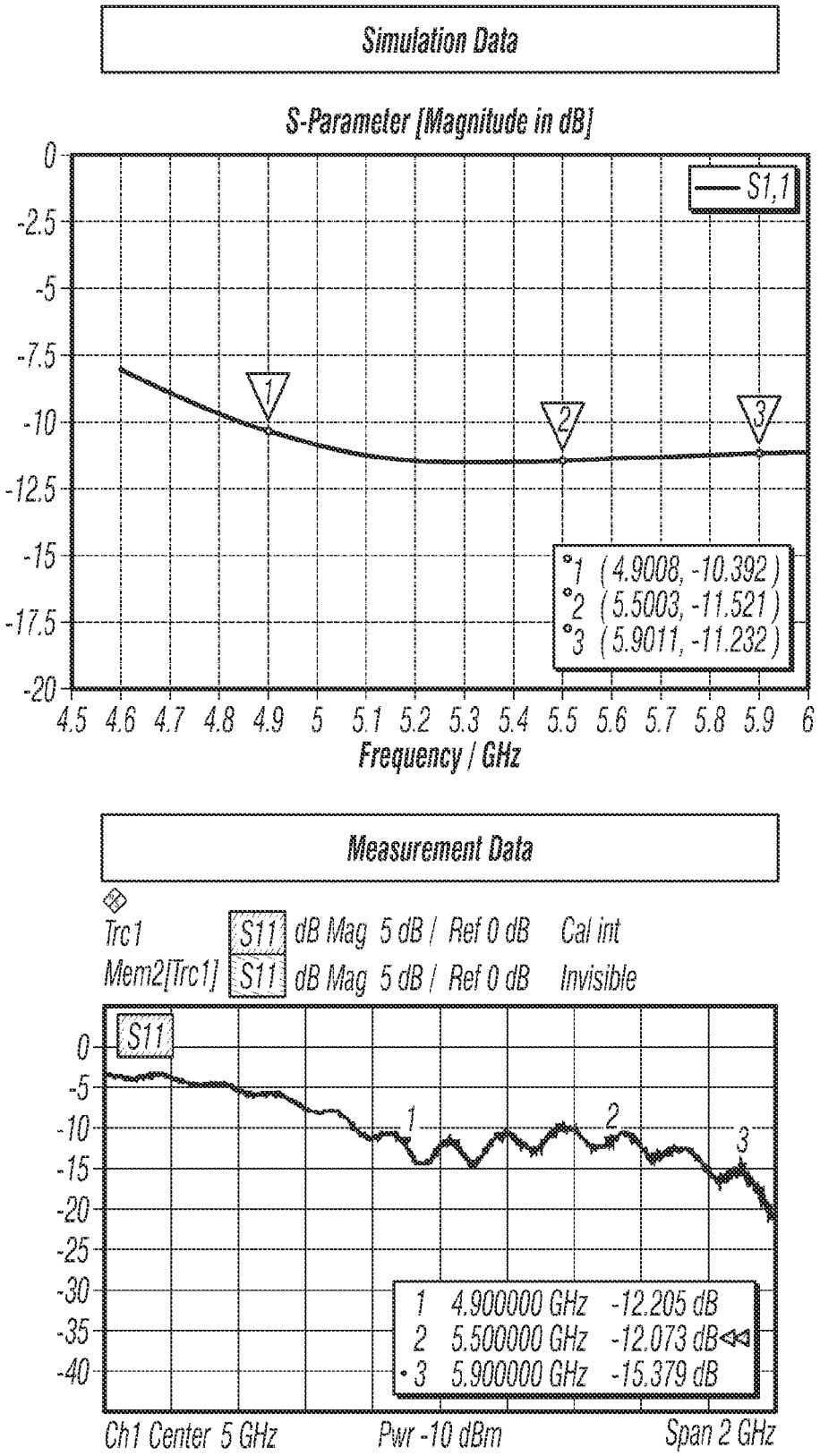
FIG. 10 provides a series of graphs showing simulation data and measurement data for a 2.4 GHz band antenna according to the invention.
Figure 10:
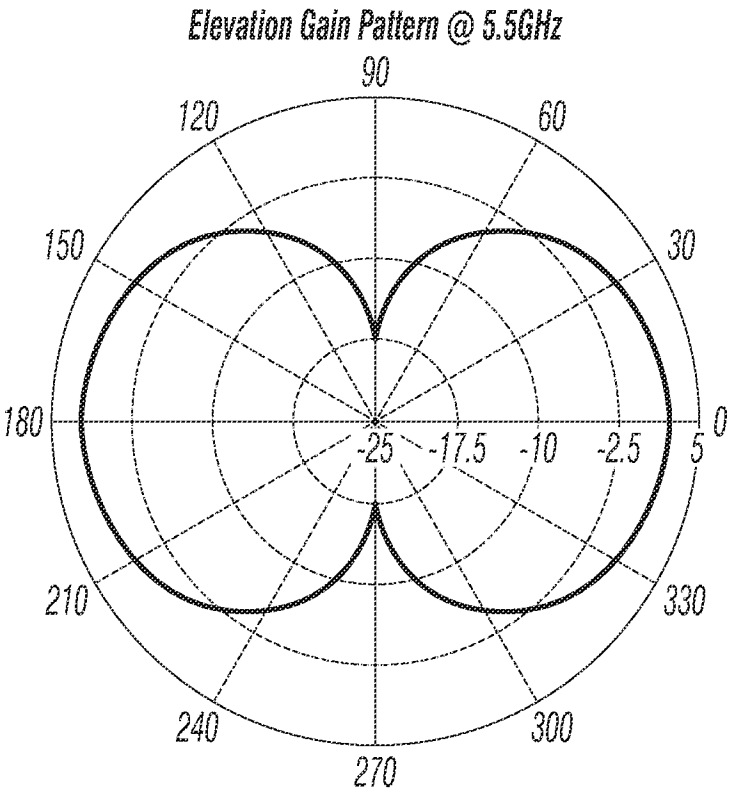
Figure 10:
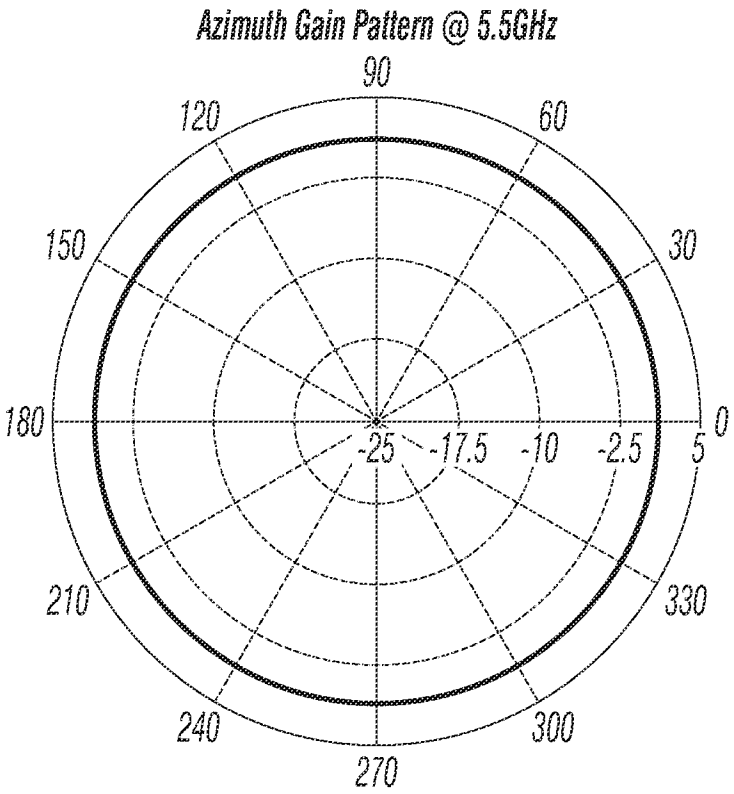
Figure 10:
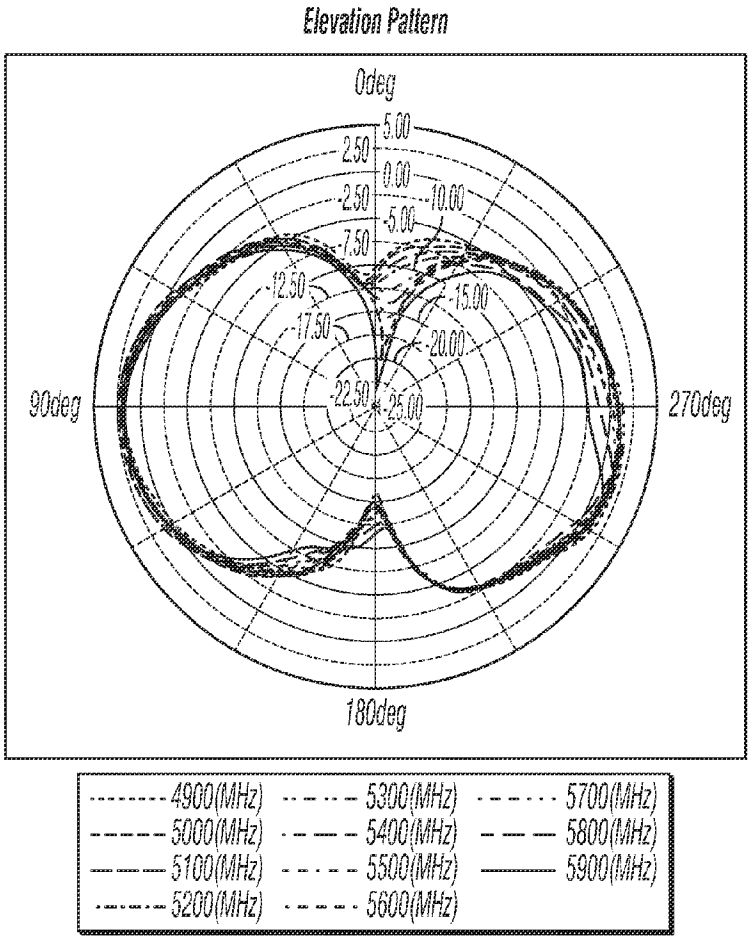
Figure 10:
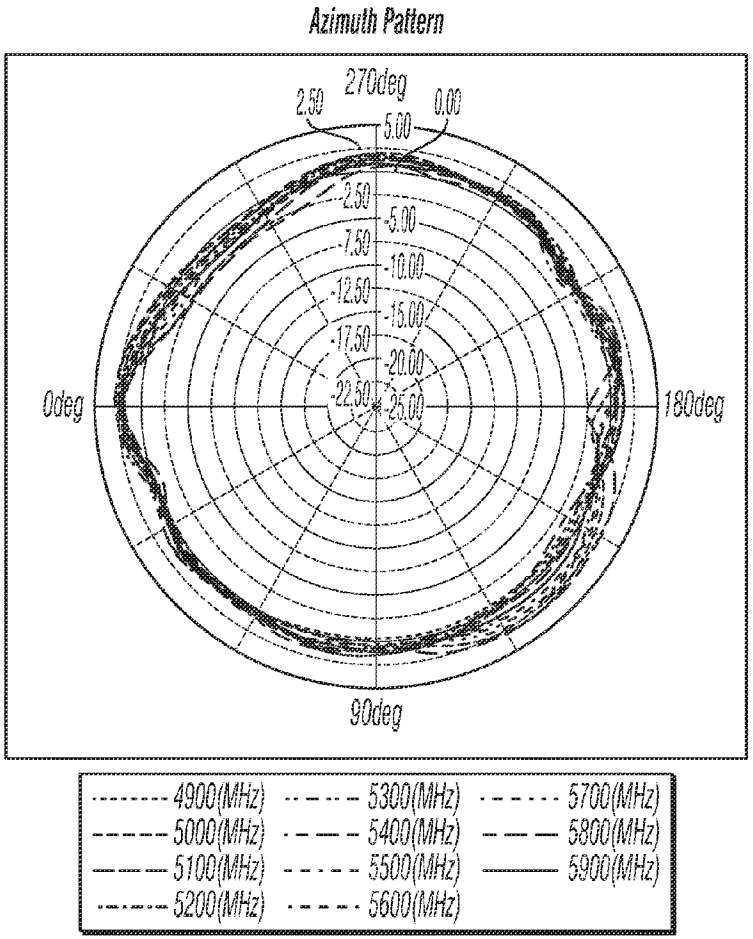

FIG. 10 provides a series of graphs showing simulation data and measurement data for a 2.4 GHz band antenna according to the invention. In particular, simulation and measurement data are shown for an S-parameter, azimuth gain, and elevation gain. As can be seen, actual measured values compare favorably with simulated values, thus confirming the merit of the antenna herein disclosed.

Dual Band

Figure 11:
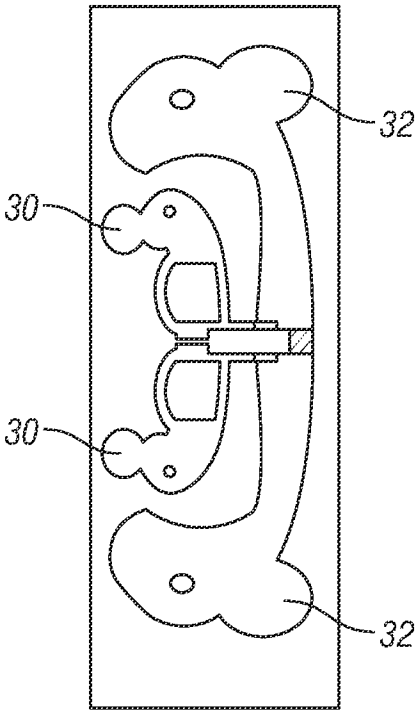
FIG. 11 is a top plan view of a PCB antenna for the 2.4 GHz band and 5 GHz band according to the invention.

FIG. 11 is a top plan view of a PCB antenna for the 2.4 GHz band and 5 GHz band according to the invention. In the embodiment of FIG. 11, radiating elements 30 are provided for the 5 GHz band and radiating elements 32 are provided for the 2.4 GHz band. In this embodiment of the invention, the radiating elements are formed in a single layer PCB having, in this case, an 11 mm width, a 30.5 mm length, and a 1.6 mm thickness, although other dimensions may be chosen.

An exemplary antenna according to the invention provides an omnidirectional radiation pattern from 2.4 GHz-2.5 GHz and 4.9 GHz-5.9 GHz with an S11<−10 dB from 2.4 GHz-2.5 GHz and 4.9 GHz-5.9 GHz. The antenna elements in this embodiment of the invention are similar to those for the antennas shown in FIGS. 1 and 6 for 2.4 GHz and 5.0 GHz, respectively.

One aspect of the invention provides an antenna that is formed on a substrate and where the antenna elements thus formed have a specific pattern. One feature of the pattern provides two openings where a the coaxial cable comes in. The outer conductor and then the center conductor of the cable are connected to the antenna and form a dipole-like structure. A dual-band embodiment of the invention resonates at two independent frequencies, but the cable carries the signals for both frequencies. In this embodiment, there are two radios on the main board of the device with which the antenna is used. The signals of each radio are routed through a diplexer and then combined into one single-ended output, which drives the antenna. The antenna is resonant to both frequencies, but the signals are split on the device board and separation or isolation of the signals is thus performed in the diplexer on the device board.

This particular antenna is used in two cases. One is a diplexer situation where there are two independent radios, but both are simultaneously excited. In this case, the signals are provided from each radio to the diplexer, and then become a one single driving point to the antenna. Alternatively, a single radio can be selected, e.g. either 2.4 gigahertz or 5 gigahertz, and can drive the same one dual-band antenna. Thus, a dual band antenna can be used for both applications.

Figure 12:
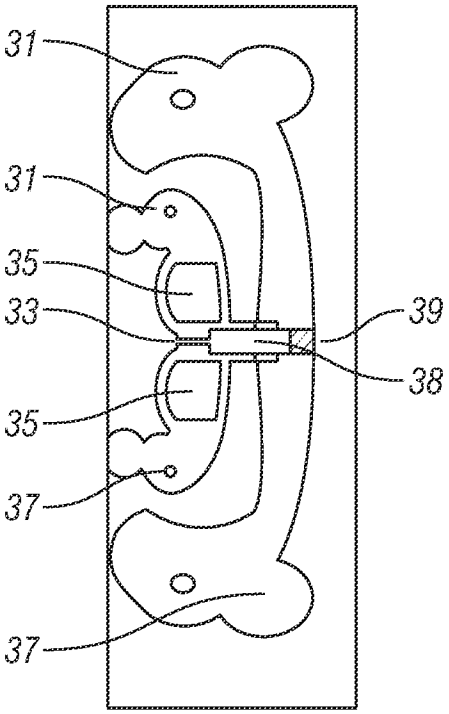
FIG. 12 is a top plan view of a PCB antenna for the 2.4 GHz band and 5 GHz band showing in simulation tuning according to the invention.

FIG. 12 is a top plan view of a PCB antenna for the 2.4 GHz band and 5 GHz band showing in simulation tuning according to the invention. The curvature shape 31 of the antenna increases the current path and lowers the antenna resonate frequency. A first critical gap 33 maintains stable antenna impedance and reactance for 5 GHz band. This embodiment has a 0.254 mm gap, although other dimensions may be used in other embodiments. A second critical gap 38 maintains stable antenna impedance and reactance for 2.4 GHz band. This embodiment has a 1 mm gap, although other dimensions may be used in other embodiments.

A metal cutout 35 is provided to increase serial inductance to miniaturize antenna size. The larger metals 37 are used to maintain wider bandwidth for each band. Thin metal 39 is used to create inductance that prevents 5 GHz energy from radiating in the 2.4 GHz elements. Therefore, the radiating patterns for 5 GHz are still omnidirectional. The serial inductance also helps miniaturize the radiation parts for the 2.4 GHz elements.

Figure 13:
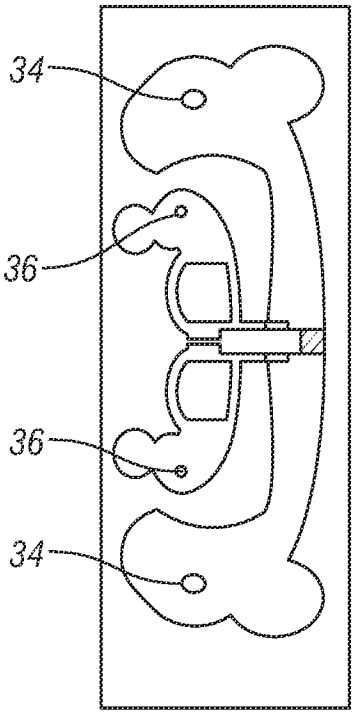
FIG. 13 is a top plan view of a PCB antenna for the 2.4 GHz band and 5 GHz band showing after production tuning according to the invention.

FIG. 13 is a top plan view of a PCB antenna for the 2.4 GHz band and 5 GHz band showing after production tuning according to the invention. During post production tuning, an increase the size of hole 34 decreases the resonate frequency for 2.4 GHz band radiating elements, while an increase the size of hole 36 decreases the resonate frequency for 5 GHz band radiating elements. In this embodiment, a 1 mm cutout forms the hole 34 for the 2.4 GHz band elements and a 0.5 mm cutout forms the hole for the 5.0 GHz band. Other size cutouts may be used in other embodiments.

Figure 14:
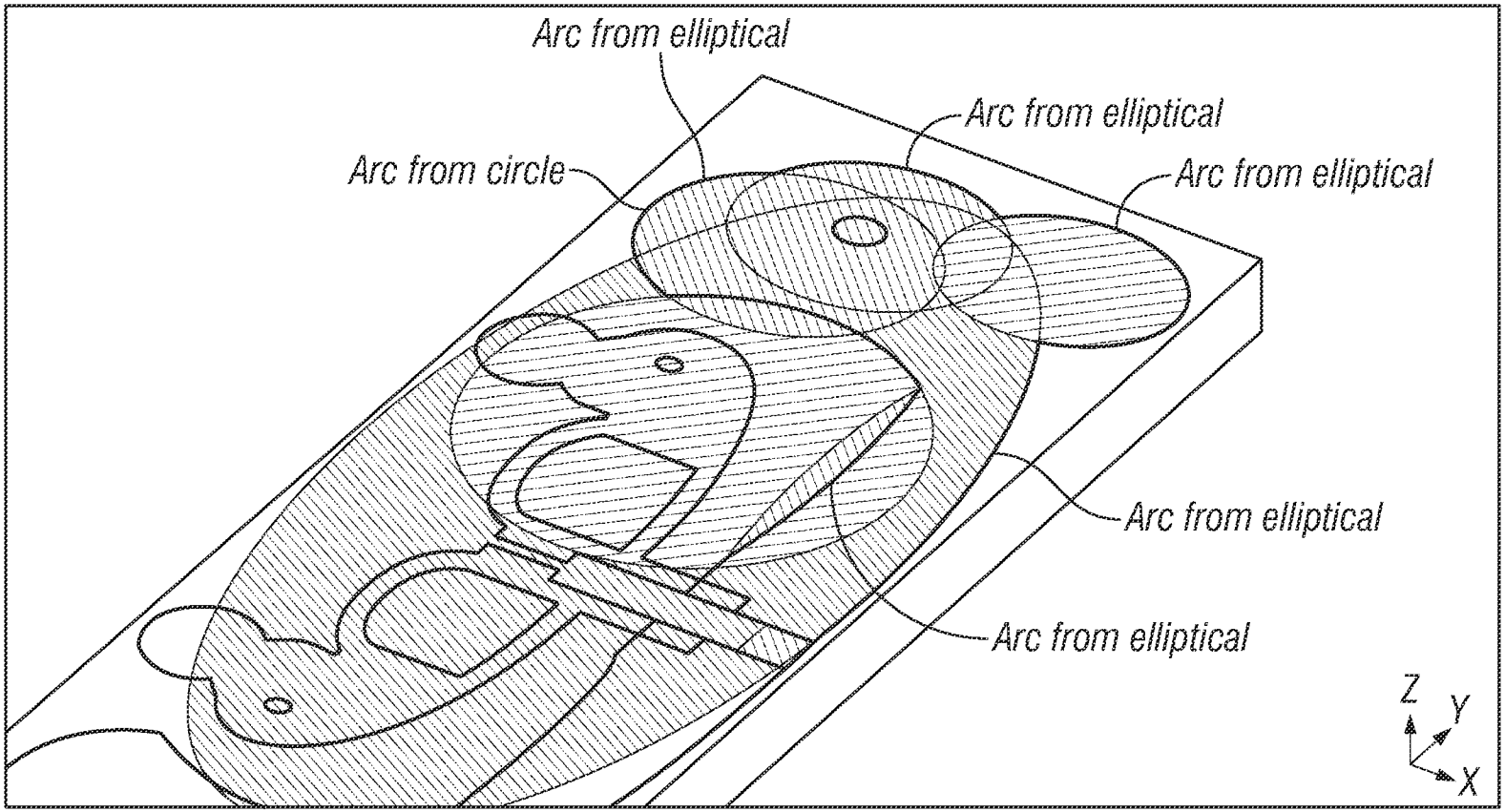
FIG. 14 is a perspective view of a substrate showing antenna layout for a 2.4 GHz portion of an antenna for the 2.4 GHz band and 5 GHz band according to the invention.
Figure 15:
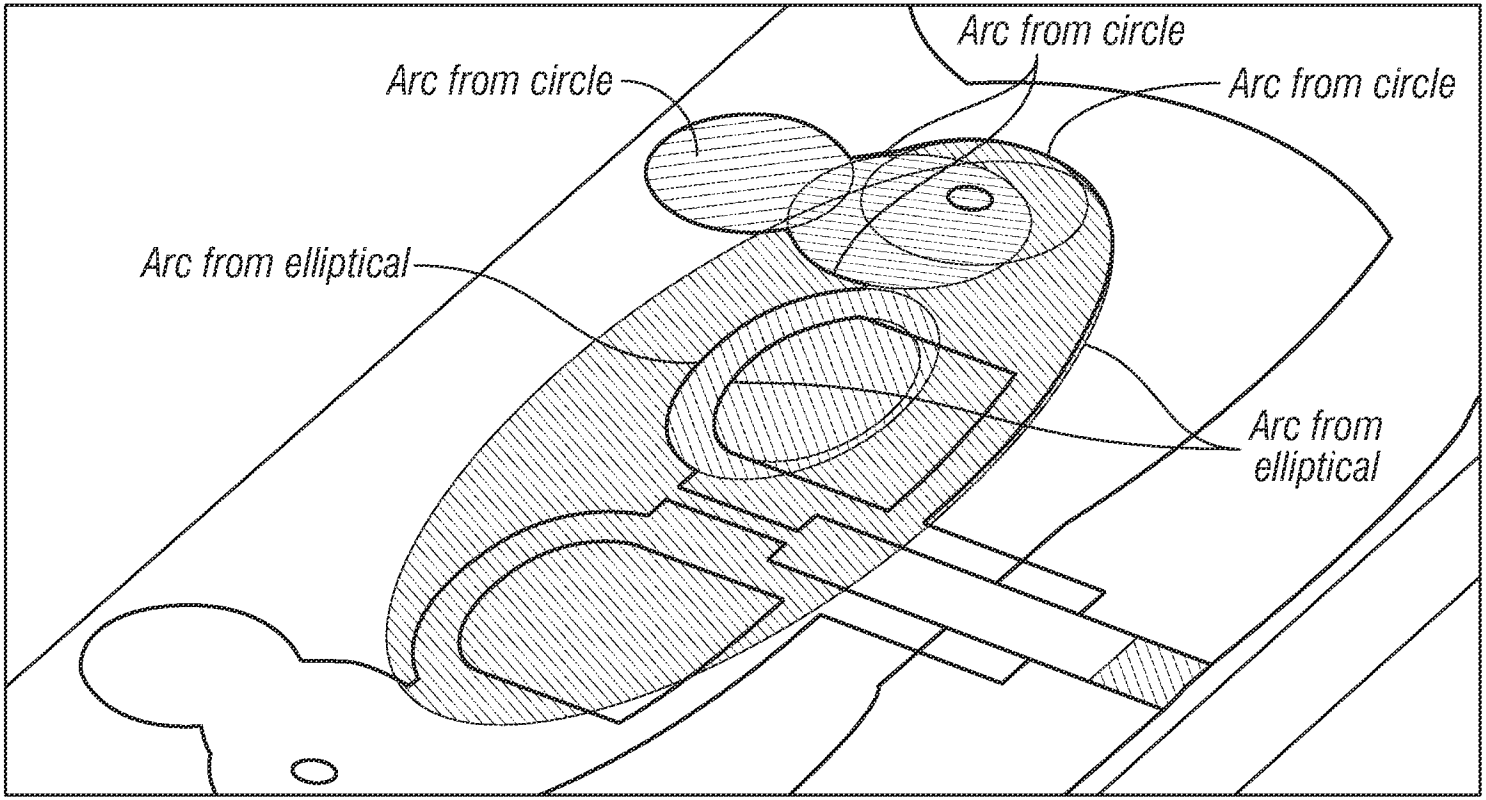
FIG. 15 is a perspective view of a substrate showing antenna layout for a 5 GHz portion of an antenna for the 2.4 GHz band and 5 GHz band according to the invention.

FIG. 14 is a perspective view of a substrate showing antenna layout for a 2.4 GHz portion of an antenna for the 2.4 GHz band and 5 GHz band according to the invention; and FIG. 15 is a perspective view of a substrate showing antenna layout for a 5 GHz portion of an antenna for the 2.4 GHz band and 5 GHz band according to the invention. In particular, it can be seen that the unique and significant shape of the antenna elements is constructed from a series of overlapping arcs. The actual shape of the antenna element is shown in outline by a solid line, while the circles that generate the arcs are shown shaded.

Figure 16:
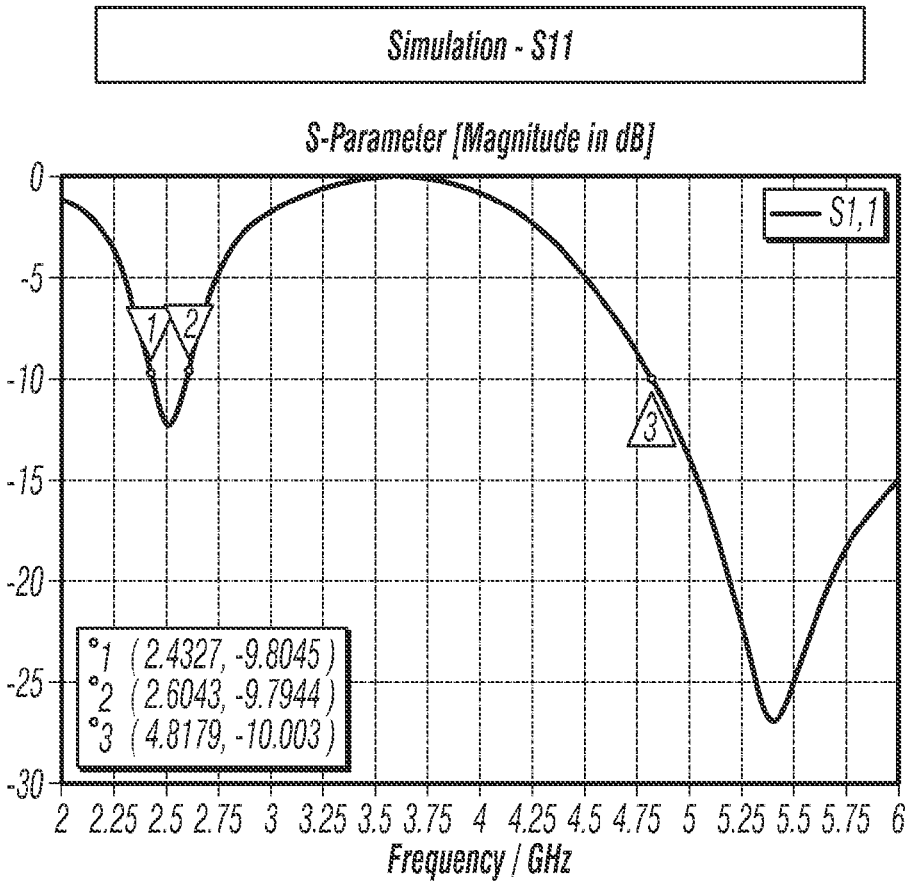
FIG. 16 provides a series of graphs showing simulation data and measurement data for a 2.4 GHz band and 5 GHz band antenna according to the invention.
Figure 16:
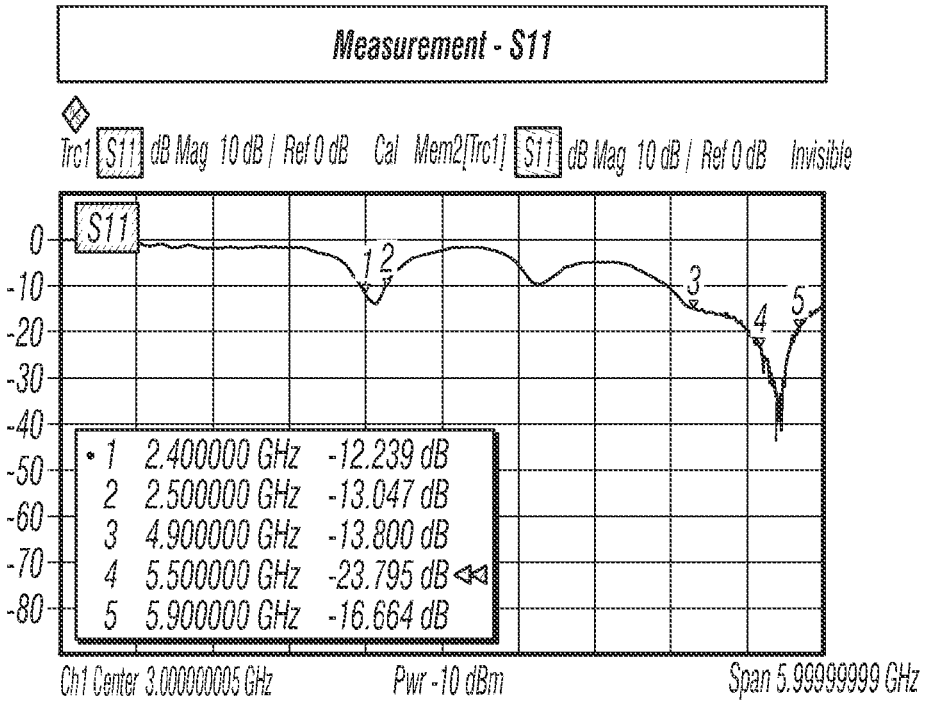

FIG. 16 provides a series of graphs showing simulation data and measurement data for a 2.4 GHz band and 5 GHz band antenna according to the invention. In FIG. 16, simulation and measurement data are shown for the S-parameter for both the 2.4 GHz and 5 GHz bands, confirming the merits of this embodiment of the invention.

Figure 17:
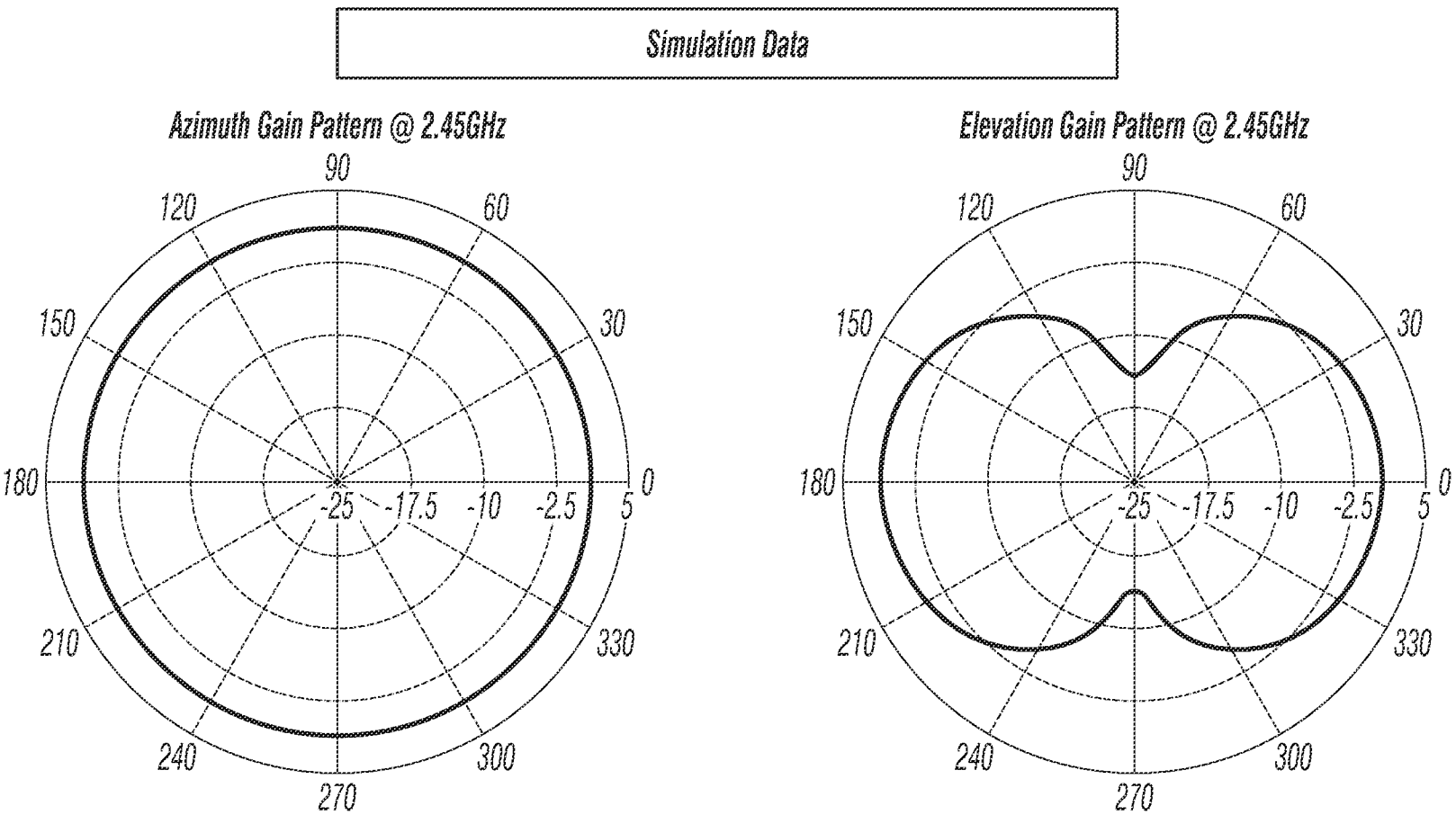
FIG. 17 provides a series of graphs showing a radiation pattern for the 2.4 GHz band for a 2.4 GHz band and 5 GHz band antenna according to the invention.
Figure 17:
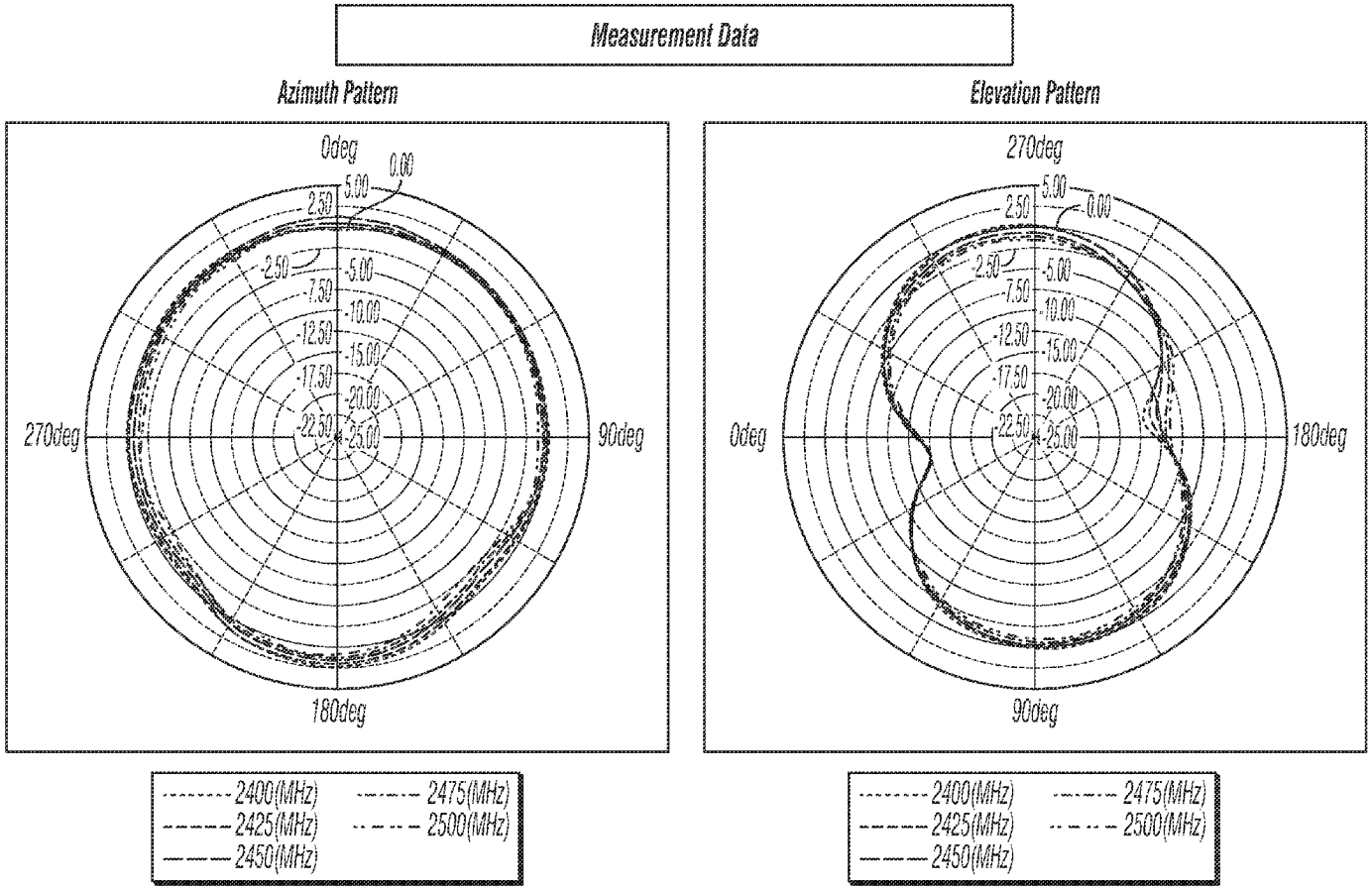

FIG. 17 provides a series of graphs showing a radiation pattern for the 2.4 GHz band for a 2.4 GHz band and 5 GHz band antenna according to the invention. In particular, simulation and measurement data are shown for azimuth gain and elevation gain. As can be seen, actual measured values compare favorably with simulated values, thus confirming the merit of the antenna herein disclosed.

Figure 18:
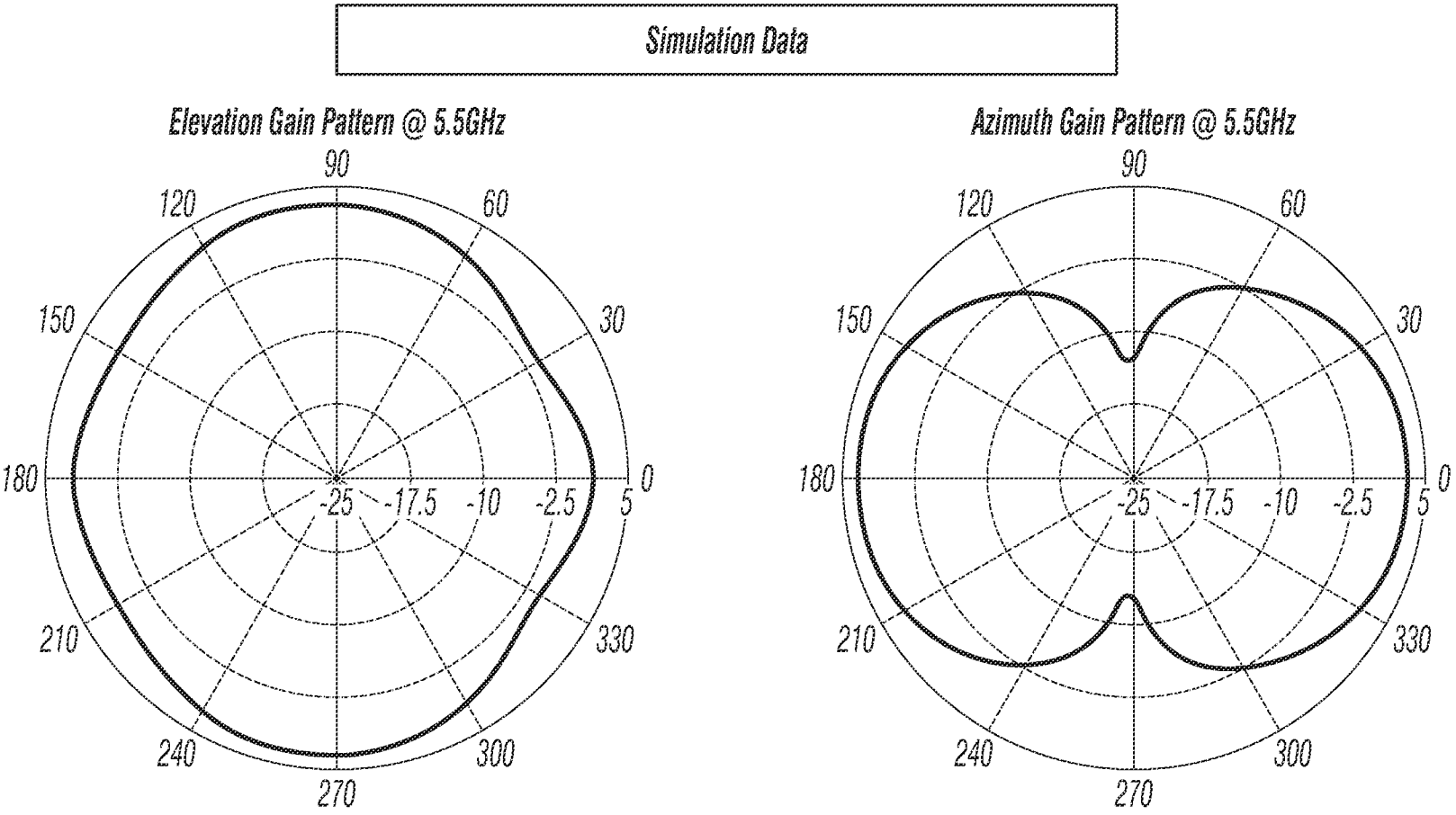
FIG. 18 provides a series of graphs showing a radiation pattern for the 5 GHz band for a 2.4 GHz band and 5 GHz band antenna according to the invention.
Figure 18:
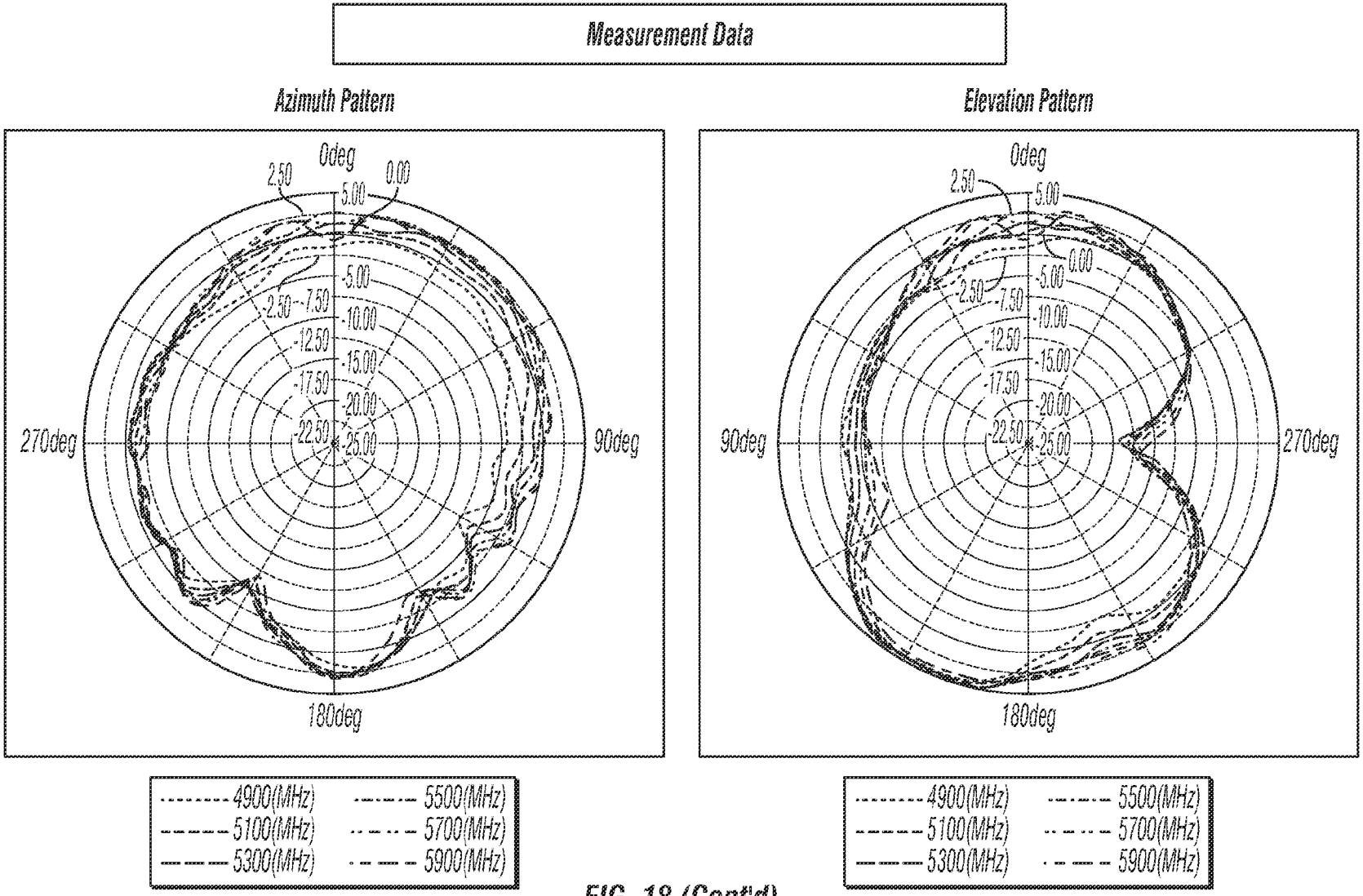

FIG. 18 provides a series of graphs showing a radiation pattern for the 5 GHz band for a 2.4 GHz band and 5 GHz band antenna according to the invention. In particular, simulation and measurement data are shown for azimuth gain and elevation gain. As can be seen, actual measured values compare favorably with simulated values, thus confirming the merit of the antenna herein disclosed.

3G/LTE

Figure 19:
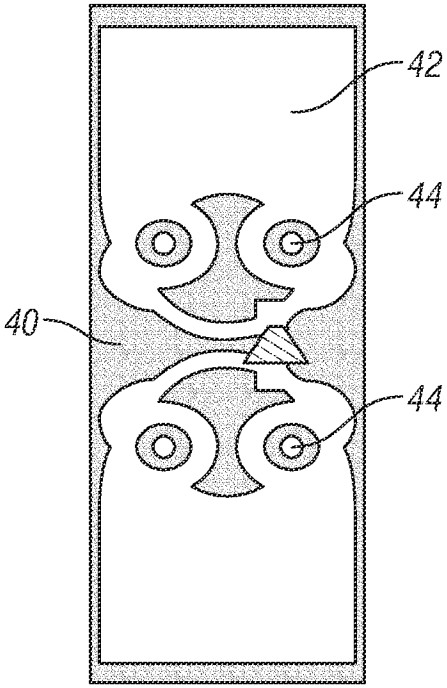
FIG. 19 is a top plan view of a PCB antenna for 3G/LTE applications according to the invention.

FIG. 19 is a top plan view of a PCB antenna for 3G/LTE applications according to the invention. In this embodiment of the invention, a metal layer 42 is formed in a single layer PCB 40 having, in this case, a width of 54.5 mm, a length of 135.5 mm, and a 1.6 mm thickness. Other embodiments may be provided having other dimensions. One or more drilled holes 44 are provided to mount the antenna. In this embodiment, 5.4 mm holes are provided, although other dimensions may be used in other embodiments.

An exemplary antenna according to the invention is a tri-band antenna that works for all the 3G/LTE bands. The exemplary antenna exhibits an S11<−8.5 dB from 690-730 MHz and an S11<−10 dB from 750-960 MHz, 1700-2100 MHz, and 2500-2700 MHz; an omnidirectional radiation (2 dBi gain) pattern from 690-960 MHz, and a directional radiation pattern (4 dBi gain) at 1700-2100 MHz and (6 dBi gain) at 2500-2700 MHz.

Figure 20:
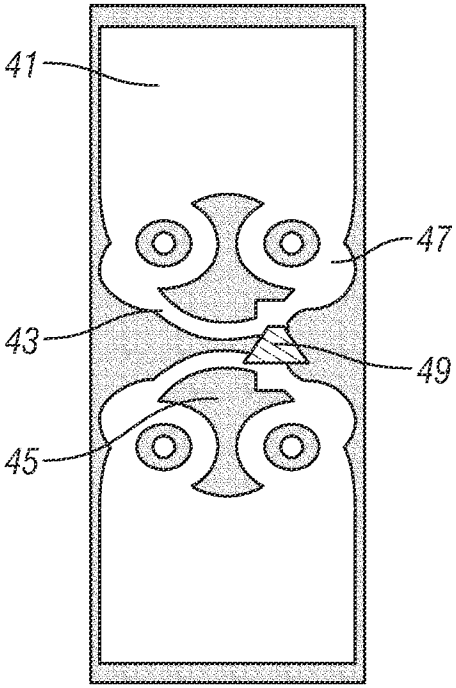
FIG. 20 is a top plan view of a PCB antenna for 3G/LTE applications showing in simulation tuning according to the invention.

FIG. 20 is a top plan view of a PCB antenna for 3G/LTE applications showing in simulation tuning according to the invention. In this embodiment, a fat dipole 41 provides wide bandwidth from the 700-1000 MHz frequency band. A thin trace 43 increases serial inductance to lower the first resonate frequency. A metal cutout 45 increases the current path and miniaturizes the antenna size. An increase in the current path 47 also creates turbulence for the current flow and creates radiation at higher frequencies. An offset feed point 49 is provided, where the offset is relatively ignorable for 700 MHz. Therefore, the radiation pattern at 700-1000 MHz is still be omnidirectional, but the offset causes an in-balance current flow and increases the gain at 1800 MHz and 2600 MHz frequency band.

Figure 21:
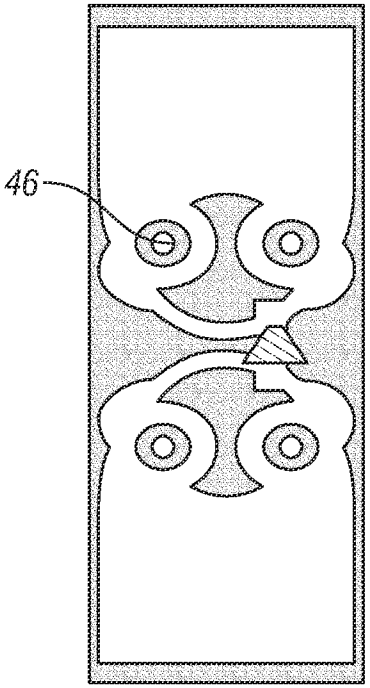
FIG. 21 is a top plan view of a PCB antenna for 3G/LTE applications showing after production tuning according to the invention.

FIG. 21 is a top plan view of a PCB antenna for 3G/LTE applications showing after production tuning according to the invention. In this embodiment, increasing the hole 46 size lowers the resonate frequency. In this embodiment, the initial size of the holes is 2 mm, although other dimensions may be used in other embodiments.

Figure 22:
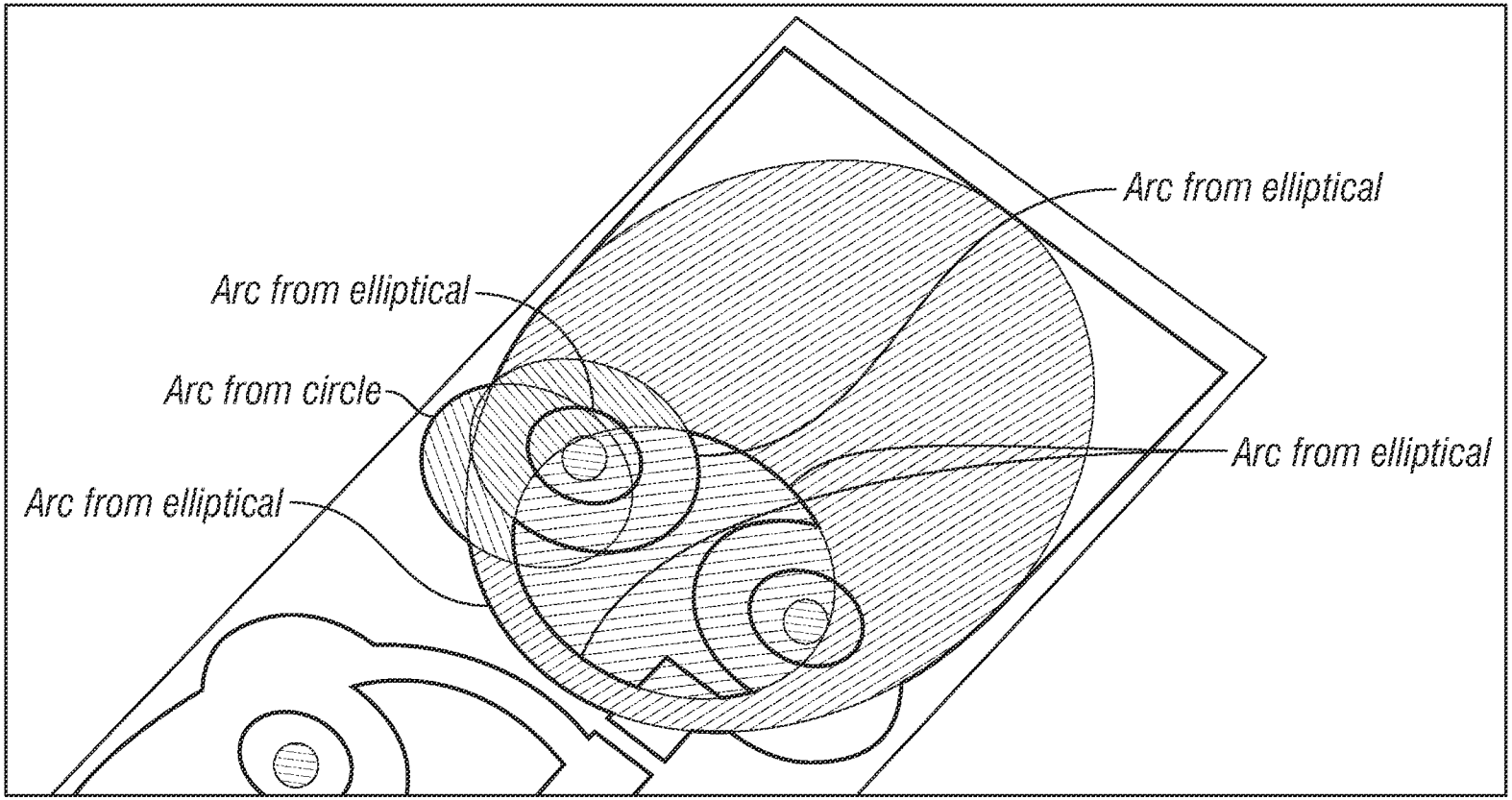
FIG. 22 is a perspective view of a substrate showing antenna layout for a 3G/LTE antenna according to the invention.

FIG. 22 is a perspective view of a substrate showing antenna layout for a 3G/LTE antenna. In particular, it can be seen that the unique and significant shape of the antenna elements is constructed from a series of overlapping arcs. The actual shape of the antenna element is shown in outline by a solid line, while the circles that generate the arcs are shown shaded.

Figure 23:
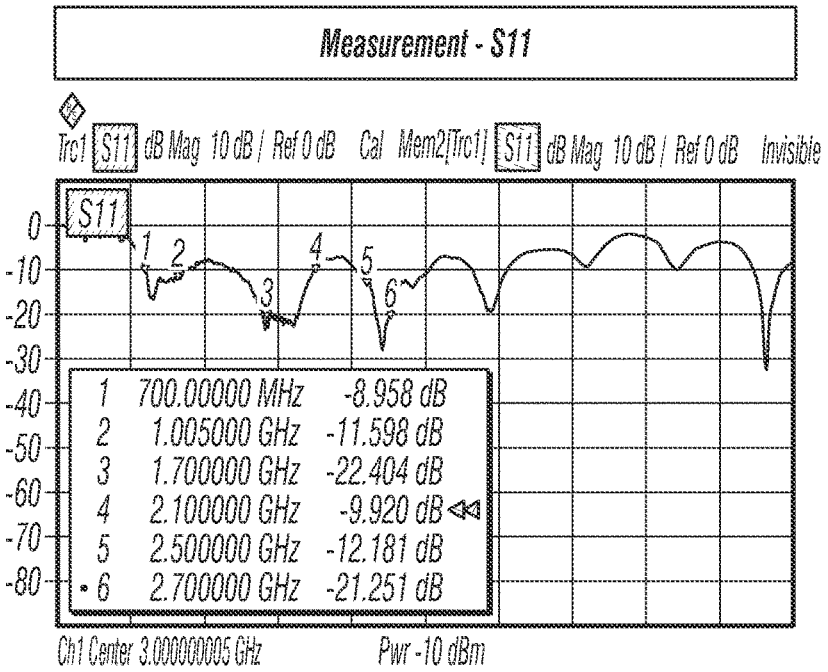
FIG. 23 provides a series of graphs showing simulation data and measurement data for a 3G/LTE antenna according to the invention.
Figure 23:
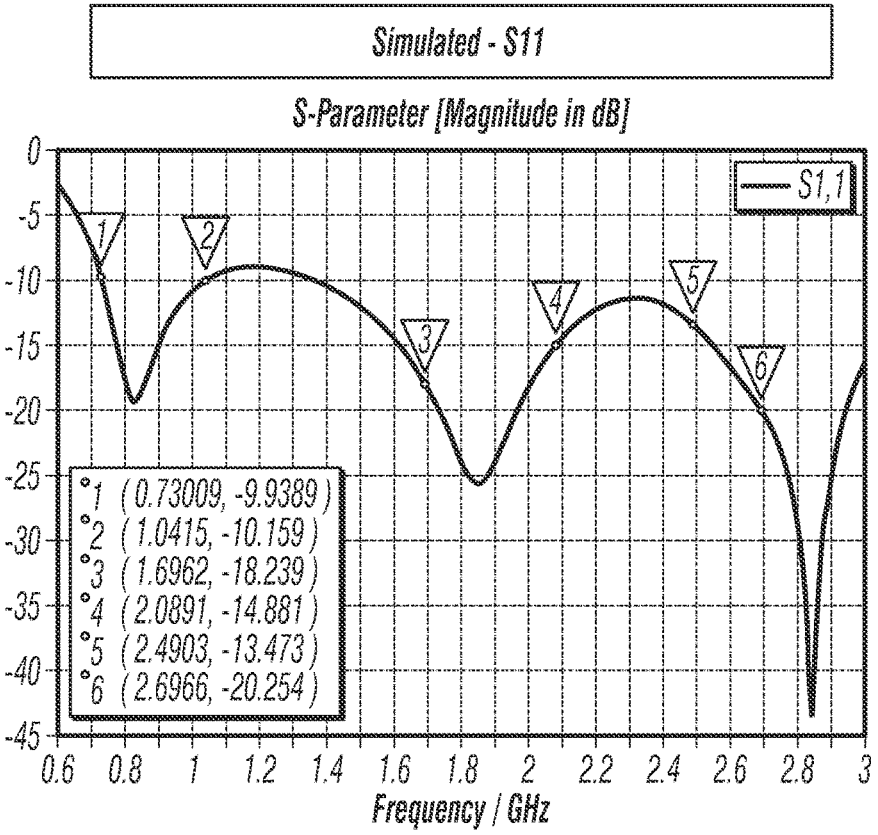

FIG. 23 provides a series of graphs showing simulation data and measurement data for a 3G/LTE antenna according to the invention.

Figure 24:
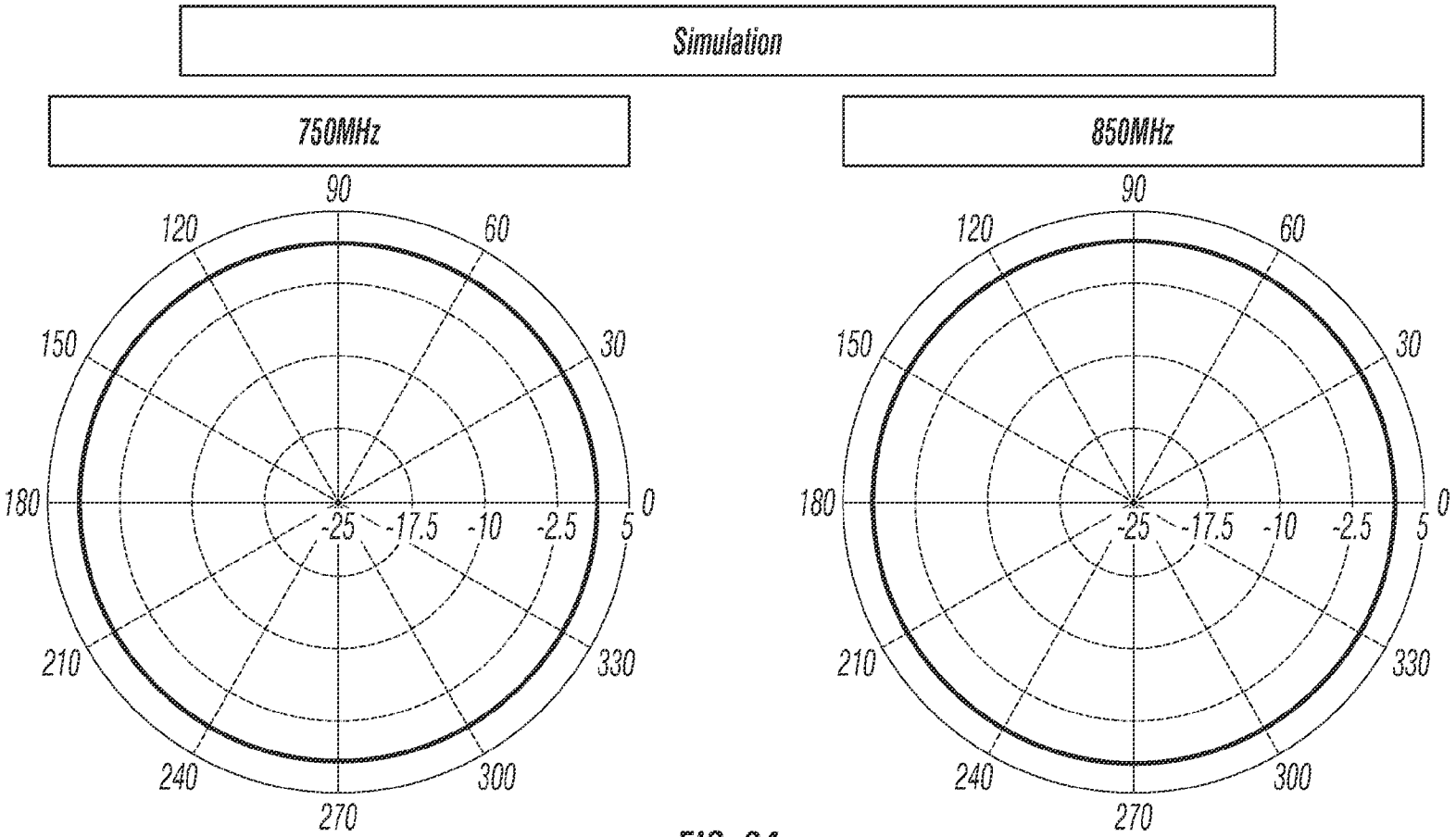
FIG. 24 provides a series of graphs showing an azimuth radiation pattern for a 3G/LTE antenna according to the invention.
Figure 24:
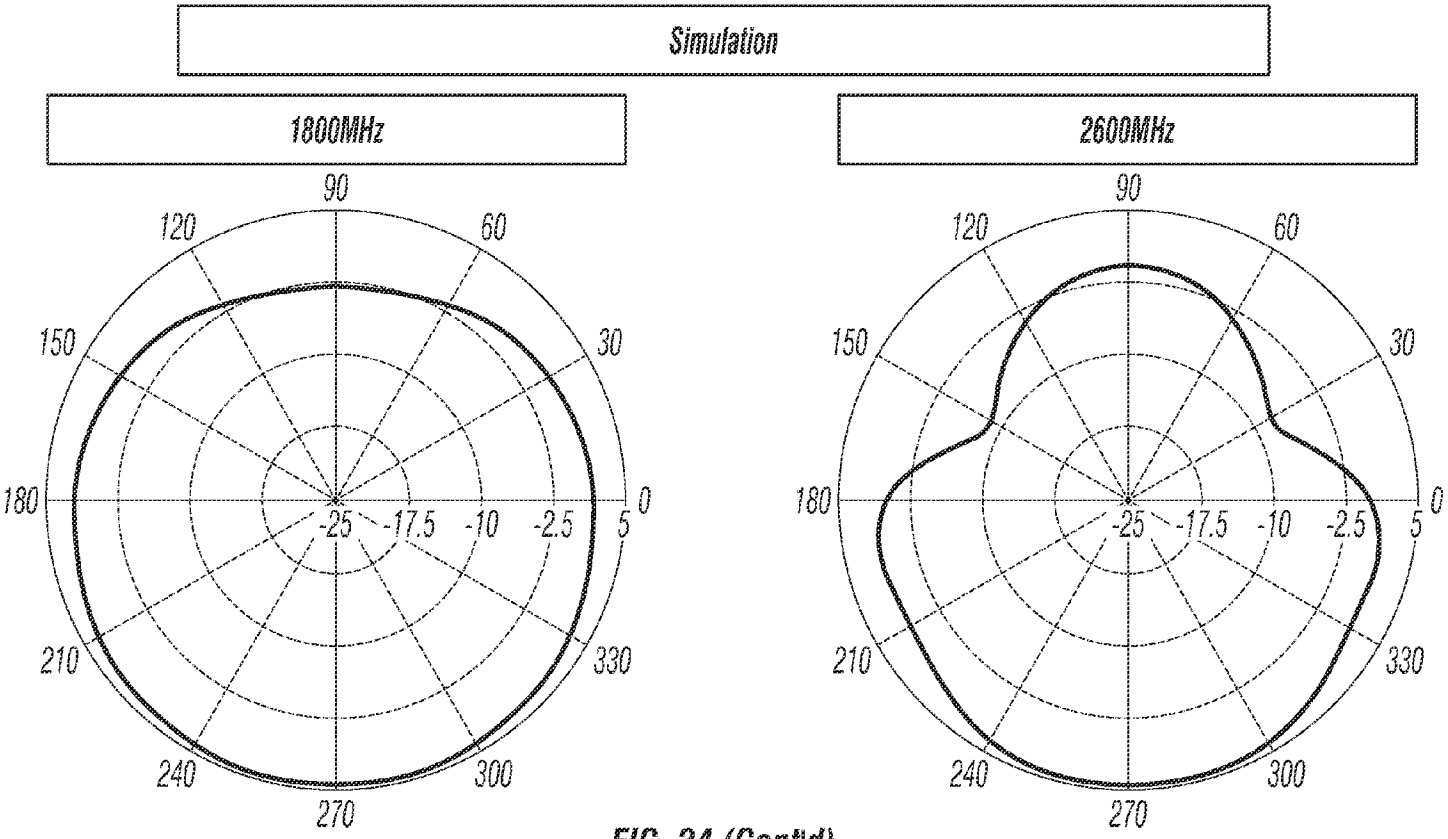
Figure 24:
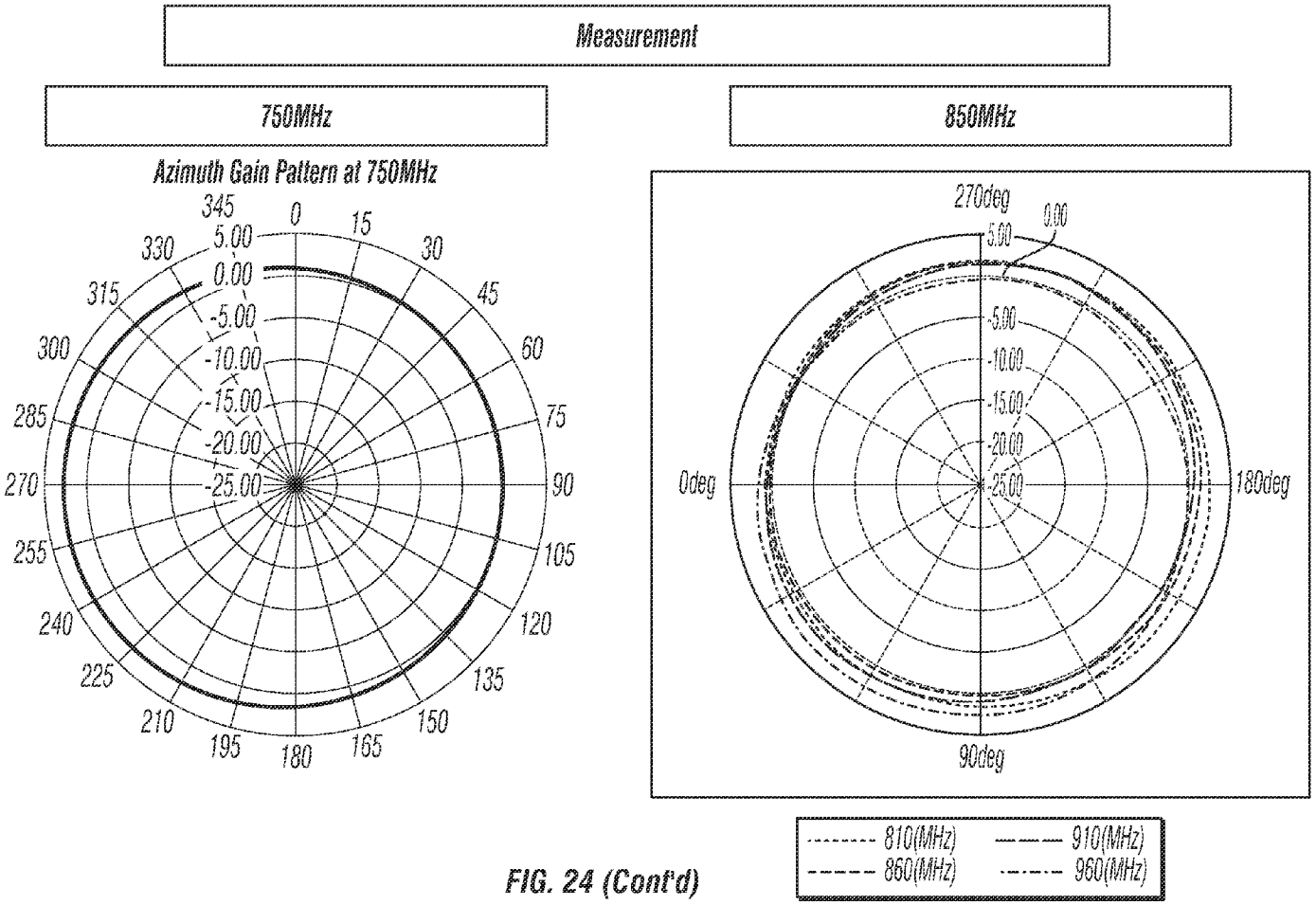
Figure 24:
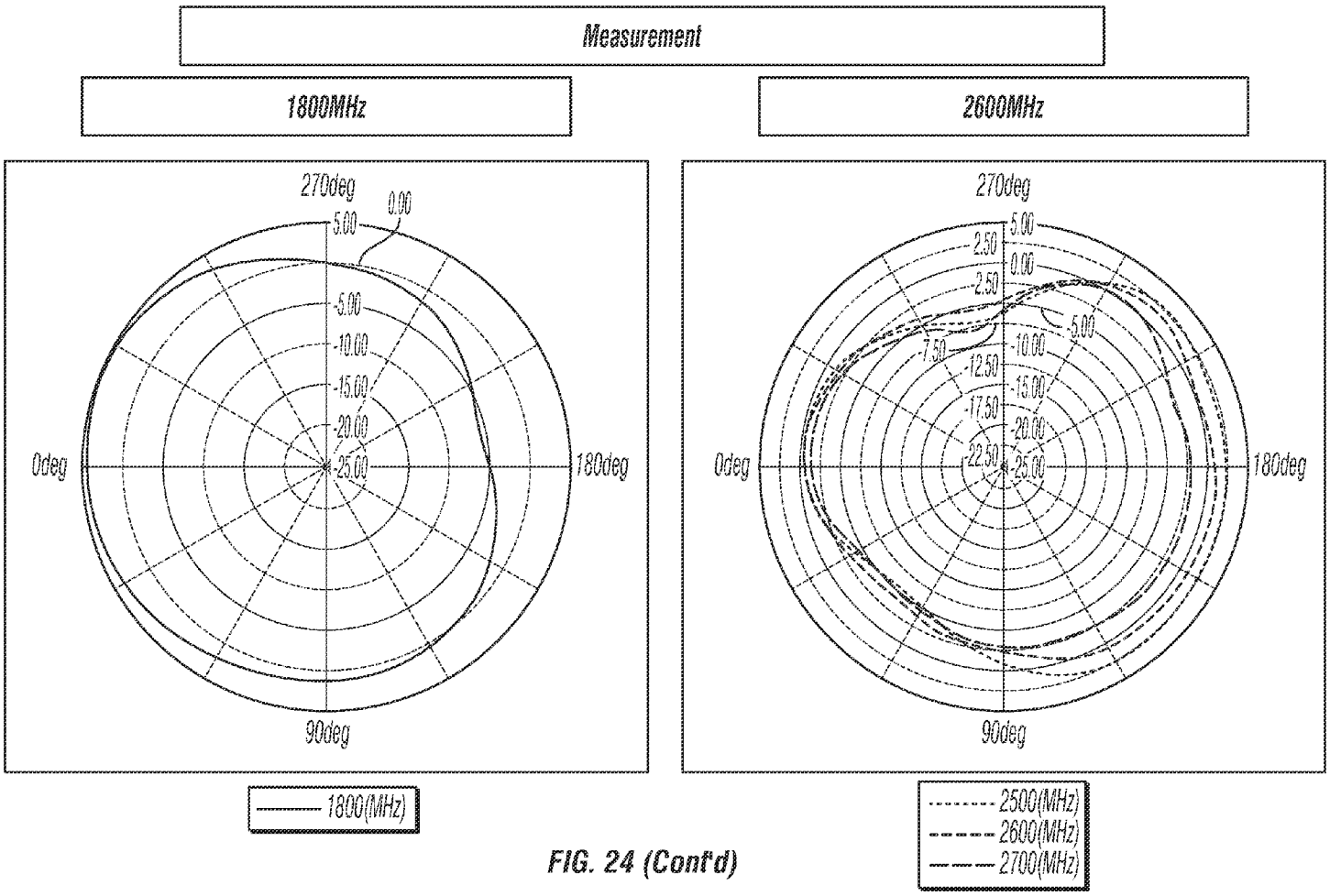

FIG. 24 provides a series of graphs showing an azimuth radiation pattern for a 3G/LTE antenna according to the invention. In FIG. 24, simulation and measurement data are shown for the S-parameter, confirming the merits of this embodiment of the invention.

Figure 25:
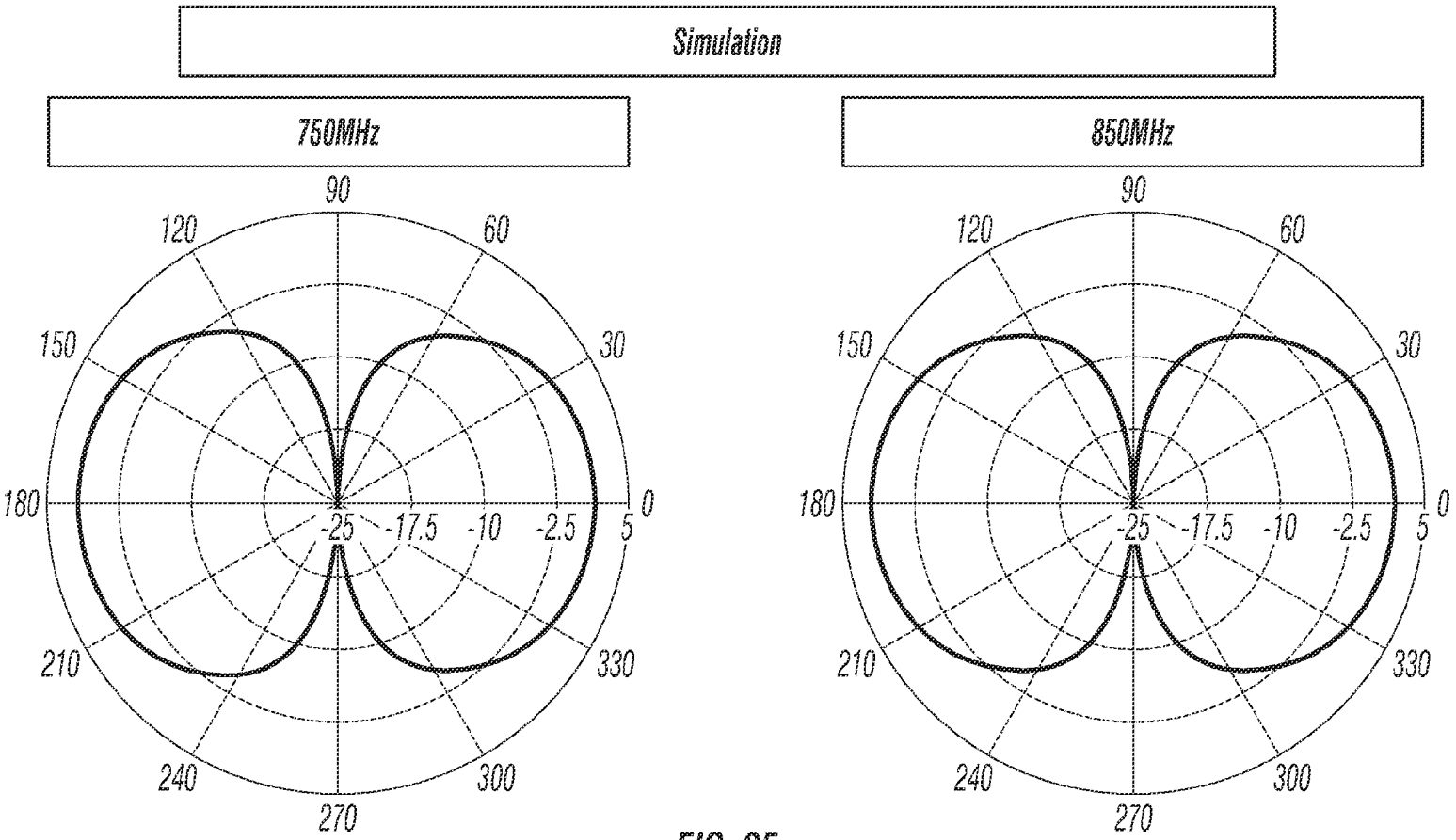
FIG. 25 provides a series of graphs showing an elevation radiation pattern for a 3G/LTE antenna according to the invention.
Figure 25:
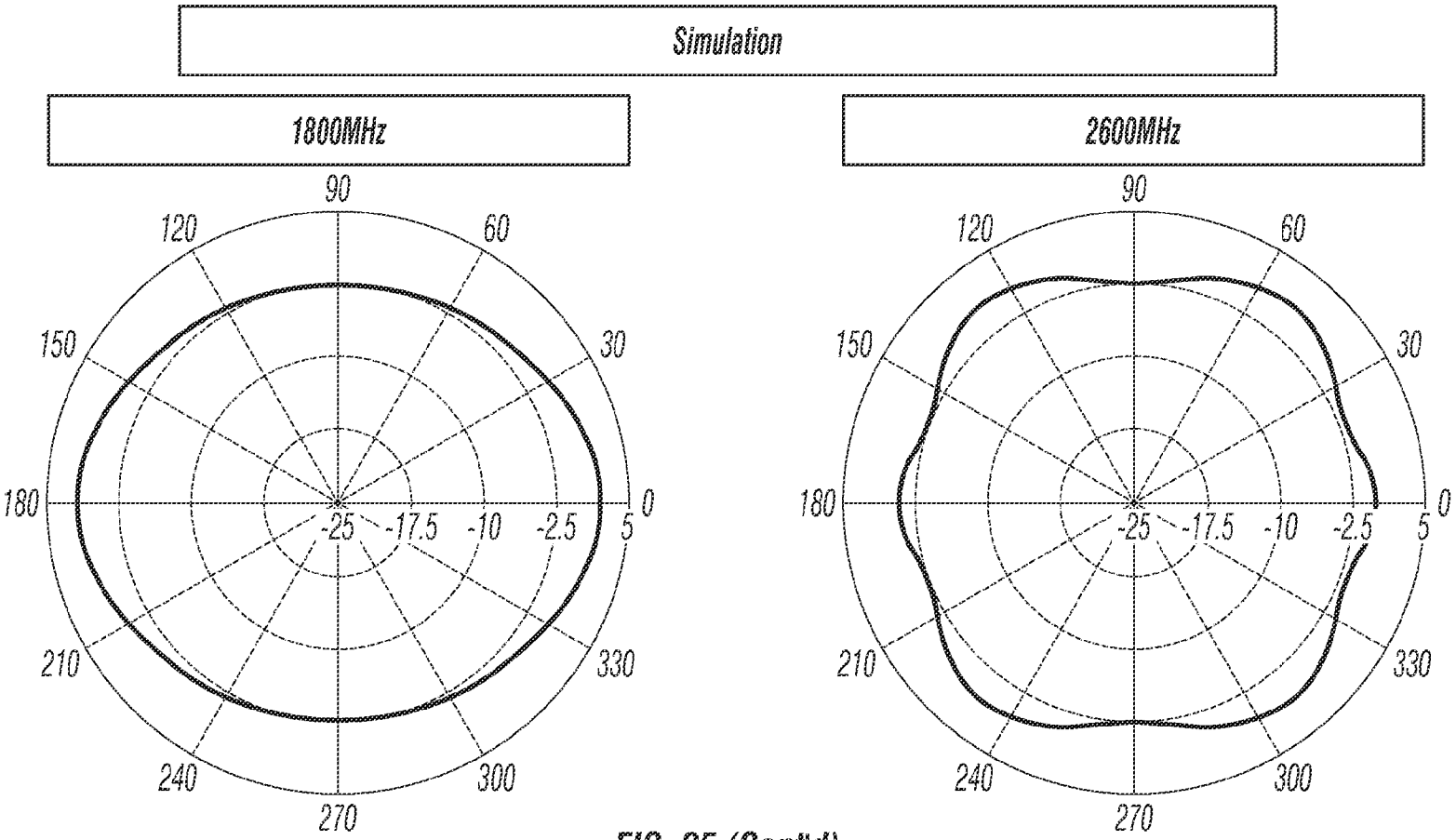
Figure 25:
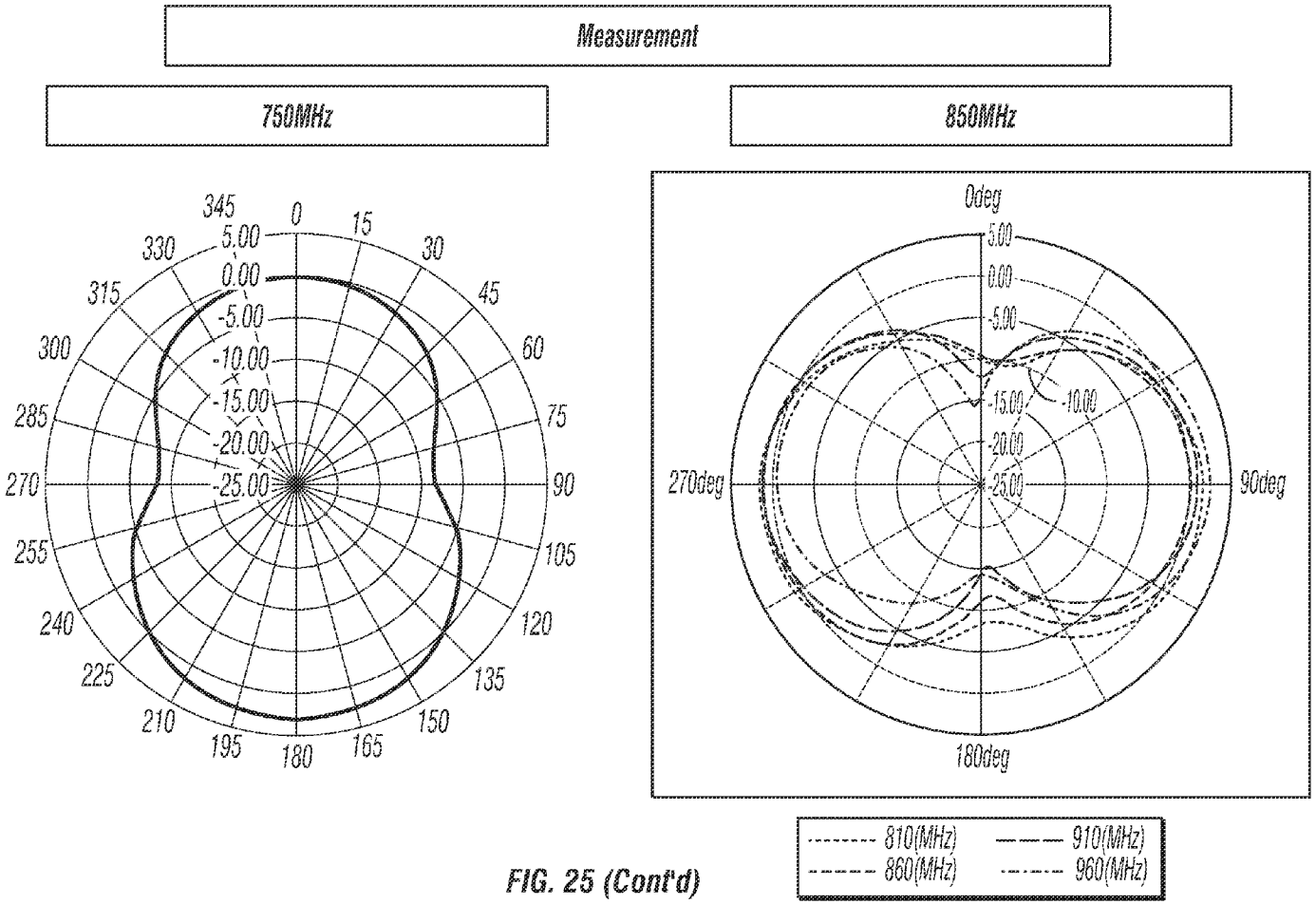
Figure 25:
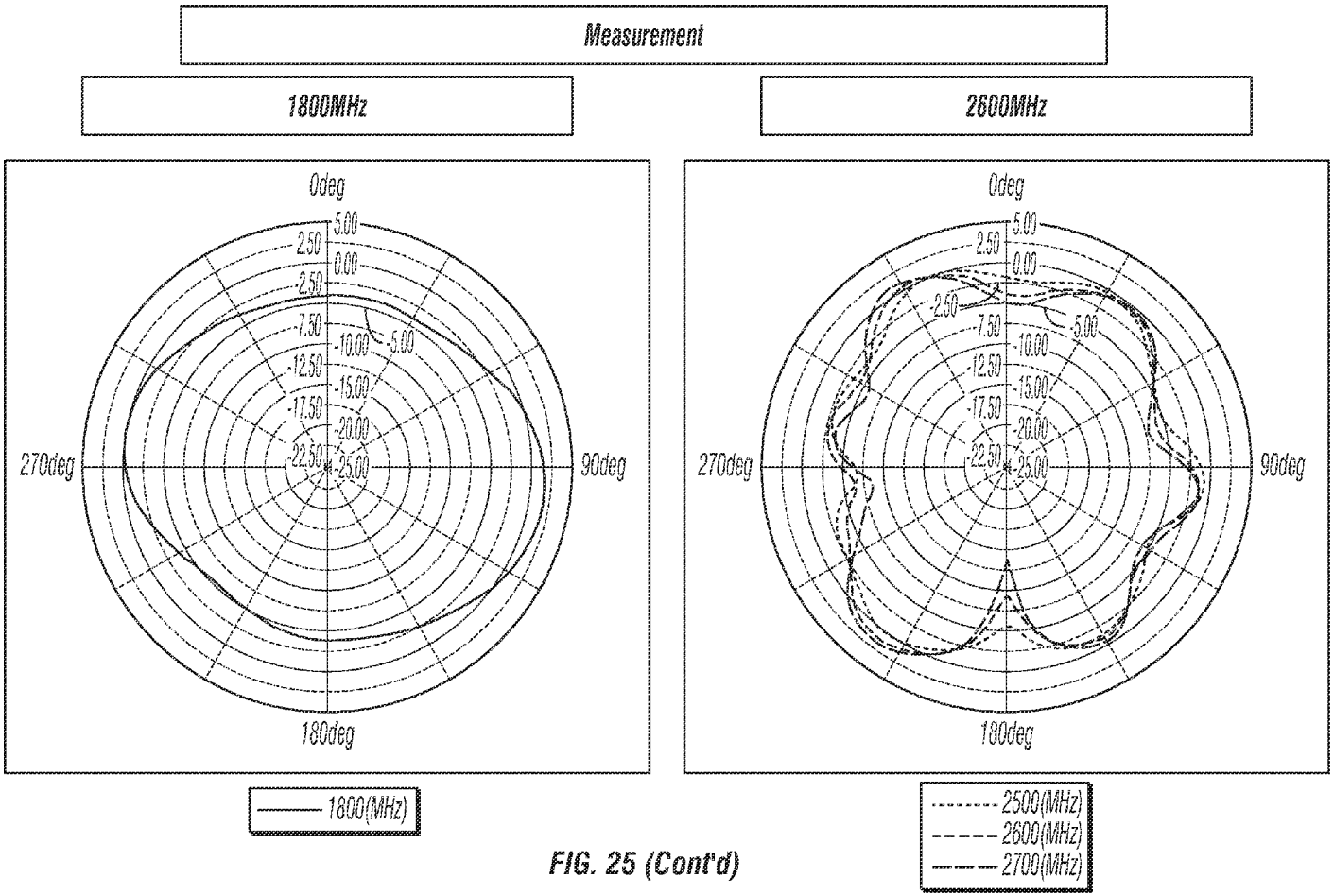

FIG. 25 provides a series of graphs showing an elevation radiation pattern for a 3G/LTE antenna according to the invention.

Performance Improvements Based Upon Mounting

Another aspect of the invention, from a manufacturing point of view, provides for a spaced mounting of the antennas. Rather than mounting the antennas directly to an enclosure, for example by sticking them directly to the enclosure, the antennas have two or more mounting openings that mate with two or more complementary plastic bosses formed into the enclosure. During manufacturing of the device that includes the antenna, the antenna is friction mounted into the boss and permanently held down at that location. Thus, no glue or other adhesive, or fastener is used to secure the antenna to the enclosure. Significantly, most commonly used enclosures are all black in color. When the plastic color changes is black, there is a carbon content increase phenomenon. When the antenna is stuck to the plastic directly, there is a loss in antenna efficiency, where the signal to and from the antenna is absorbed because a black plastic enclosure has a high carbon content. The amount of signal absorbed by the enclosure can be up to 5 to 10 percent if the antenna is mounted directly to the plastic enclosure versus lifting the antenna around five mm or so from the plastic. Thus, with the use of the herein enclosed mounting technique it is possible to get up to 5 to 10 percent efficiency increase.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. An antenna, comprising:

two conductive metal antenna elements, each element comprising one-half of a dipole antenna;

each antenna element being a mirror image of the other and formed on a rigid substrate in spaced relation to define a gap there between that provides stable antenna impedance and reactance, a portion of each antenna element at said gap defining a connection pad for connecting a coaxial cable thereto, each antenna element having a profile defining a curved, semi-circular inner edge and an arc-shaped outer edge that define the connection pad of the antenna element at the gap;

wherein each antenna element extends from a narrow portion thereof to a point where the edges diverge and define a wide, curved upper element portion that provides wide bandwidth performance;

wherein the curve is provided to increase a current path and shift a resonate frequency of the antenna lower, the outer edge of each antenna element further defining a semi-circular, triangle peak projection that bulges from an upper portion of the outer antenna element edge and that provides serial inductance to miniaturize the antenna size.

2. The antenna of claim 1, wherein said antenna operates in the 5 GHz band.

3. The antenna of claim 1, wherein each antenna element is formed on a single layer PCB.

4. The antenna of claim 1, wherein said gap is about 0.5 mm.

5. The antenna of claim 1, each antenna element defining therein one or more tuning holes that have an initial diameter, wherein selectively enlarging the diameter of one or more of said holes establishes a desired antenna characteristic.

6. The antenna of claim 1, wherein the profile each of said antenna elements is constructed from a series of overlapping arcs.

7. The antenna of claim 1, wherein said elements provide an omnidirectional radiation pattern radiation pattern of about 4.9 GHz-5.9 GHz and an S11<−10 dB from 4.9 GHz-5.9 GHz with more than 20% bandwidth.

* * * * *